US007003258B2

(12) United States Patent
Adachi et al.

(10) Patent No.: US 7,003,258 B2
(45) Date of Patent: Feb. 21, 2006

(54) TRANSFER DEVICE, TRANSFER METHOD AND IMAGE FORMING DEVICE

(75) Inventors: Koji Adachi, Nakai-machi (JP); Kaoru Yasukawa, Nakai-machi (JP); Norikazu Yamada, Nakai-machi (JP); Eigo Nakagawa, Nakai-machi (JP); Koki Uwatoko, Nakai-machi (JP); Tetsuichi Satonaga, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/819,938

(22) Filed: Apr. 8, 2004

(65) Prior Publication Data

US 2005/0019075 A1 Jan. 27, 2005

(30) Foreign Application Priority Data

Jul. 25, 2003 (JP) ..... 2003-201466

(51) Int. Cl.
*G03G 15/00* (2006.01)
*B41J 11/32* (2006.01)

(52) U.S. Cl. ..... 399/395; 399/388; 399/394; 400/579; 400/630; 400/631; 400/632; 400/632.1; 271/264; 271/265.01; 271/3.14; 271/3.18

(58) Field of Classification Search ..... 399/395, 399/394, 388; 271/264, 265.01, 3.14, 3.08; 400/579, 630, 631, 632, 632.1
See application file for complete search history.

(56) References Cited

U.S. PATENT DOCUMENTS 4,255,064 A * 3/1981 Kelly ..... 400/708
5,028,042 A * 7/1991 Yamada et al. ..... 271/9.06
5,149,980 A 9/1992 Ertel et al.
5,578,813 A 11/1996 Allen et al.
5,578,817 A 11/1996 Bidiville et al.
5,644,139 A 7/1997 Allen et al.

(Continued)

FOREIGN PATENT DOCUMENTS

GB 2287457 A * 9/1995
JP A 3-53219 3/1991

(Continued)

OTHER PUBLICATIONS

Shimane University, "Electronic Measurement Lecture Content (6.25)," http://ecs.riko.shimane-u.ac.jp/~nawate/lecture/inst/6-25/6-25.html, printed Apr. 6, 2004.

(Continued)

*Primary Examiner*—Andrew H. Hirshfeld
*Assistant Examiner*—Marvin P. Crenshaw
(74) *Attorney, Agent, or Firm*—Oliff & Berridge, PLC

(57) ABSTRACT

A transfer device for transferring an object to be transferred in a predetermined direction has a drive mechanism unit, a transfer direction displacement information acquiring unit, a skew direction displacement information acquiring unit, and a transfer processing unit. The drive mechanism unit also has roll parts which cause the object to be transferred to move in the direction with a rotational force.

The transfer direction displacement information acquiring unit and the skew direction displacement information acquiring unit radiate a predetermined measuring wave toward the object, so that the units acquire the displacement information in each of the directions. Based on the displacement information, the transfer processing unit performs a predetermined processing.

18 Claims, 10 Drawing Sheets

U.S. PATENT DOCUMENTS

| | | | | |
|---|---|---|---|---|
| 5,686,720 | A | 11/1997 | Tullis | |
| 5,715,514 | A * | 2/1998 | Williams et al. | 399/395 |
| 5,729,008 | A | 3/1998 | Blalock et al. | |
| 5,731,680 | A * | 3/1998 | Winterberger et al. | 318/685 |
| 6,644,875 | B1 * | 11/2003 | Sakaino et al. | 400/579 |
| 6,666,600 | B1 * | 12/2003 | Shirota et al. | 400/579 |

FOREIGN PATENT DOCUMENTS

| | | |
|---|---|---|
| JP | A 6-72625 | 3/1994 |
| JP | A 2000-270169 | 9/2000 |
| JP | A 2002-308477 | 10/2002 |

OTHER PUBLICATIONS

Canon, Canon-Optoelectronics Components, http://www.canon.com/optoelectro/Doppler/flash_e.html, printed Apr. 6, 2004.

Canon, Canon-Optoelectronics Components: Canon Laser Doppler Velocity Sensor, http://www.canon.com/optoelectro/Doppler/index.html, printed Apr. 6, 2004.

Canon, http://cweb.canon.jp/indtech/es/ldvm.html, printed Apr. 6, 2004.

* cited by examiner

TRANSFER DEVICE, TRANSFER METHOD AND IMAGE FORMING DEVICE

BACKGROUND OF THE INVENTION

1. Field of the Invention

The present invention relates to an image forming device such as a copying machine, a printer, facsimile device, or a composite machine having the functions of all of those machines and device, as well as a transfer device in the image forming device.

2. Description of Related Art

In an electronic copying machine or a printer there is used a transfer device for transferring printing paper as an object to be transferred in a predetermined direction. The transfer device has, as principal components, transferring rolls in various positions of a transfer path which rolls are driven by means of a motor. Heretofore, for stabilizing the state of transfer of printing paper, the printing paper transferring velocity has been made constant by making the number of revolutions of the transferring rolls driving motor constant.

In the conventional transfer device, however, there has been the problem that as the transfer device is used, the paper transferring velocity decreases even if the number of revolutions of the motor is kept constant, due to wear of the transferring rolls or adhesion of paper dust to the transferring rolls. Additionally, due to wear of the transferring rolls or adhesion of paper dust to the same rolls, there arises offset in the transfer of paper, and the occurrence of skew may result. The term "skew" is a generic term for movement or inclined travel of a to-be-transferred object in a direction orthogonal to the transferring direction of the to-be-transferred object.

On the other hand, recently, various machines, especially office machines such as copying machines or printers, are required to be manufactured in high productivity and therefore a delay thereof due to a fault is not allowed, but it is required to promptly detect the fault and remedy it. Particularly, a large number of components capable of operating at high speed and high accuracy are mounted in various recent machines. Above all, drive parts such as motor and solenoid, as well as power transfer parts such as gears and rollers adapted to operate in interlock with the drive parts, including drive circuits for driving motors, etc., are generally high in the frequency of fault occurrence in comparison with other electronic components (passive electronic parts such as resistors and capacitors, or transistors and IC (integrated circuit)). Particularly in the case where the working environment is very bad, even if the components in question are used in a normal manner, there occur various troubles and faults difficult to be detected and a great deal of labor is required for remedying such troubles and faults.

For example, such consumable parts as transferring rolls differ in the degree of wear or deterioration, depending on working conditions and environment conditions of a place where the rolls are installed. Therefore, it is impossible to correctly guess when such consumable parts as transferring rolls are to be replaced. From only the number of transferred sheets of printing paper or from elapsed time, it is impossible to guess when consumable parts are to be replaced. Accordingly, heretofore, such consumable parts have been replaced earlier than an appropriate time, thus giving rise to the problem of a great loss. Thus, measuring a change in paper transferring velocity or a skew quantity and estimating an appropriate time when consumable parts are to be replaced, are essential from the standpoint of executing maintenance and servicing efficiently.

Various mechanisms have been proposed wherein the state of motion of a moving object is detected using a measuring wave. As examples of measuring devices using a measuring wave, there are known optical displacement information measuring devices such as a laser Doppler velocity meter and a laser encoder. The laser Doppler velocity meter measures the moving velocity of a moving object by utilizing the Doppler effect such that when a laser beam is applied to a moving object, the frequency of scattered light from the moving object shifts in proportion to the moving velocity.

Further, there are proposed mechanisms wherein light is applied to an object, then reflected light from the object is received by a photo-detector array, and a structural feature appearing on the surface of the object is observed, thereby detecting the position and motion of the object.

These mechanisms which employ a measuring wave to detect the state of motion of a moving object are considered effective in implementing the function of monitoring movement in transfer direction or in skew direction of printing paper being transferred and controlling the transferring operation on the basis of the result of the monitoring, also effective in implementing a troubleshooting function involving error processing in the event the result of the monitoring should exceed a predetermined reference, and further effective in implementing the function of diagnosing deterioration of transfer-related components.

SUMMARY OF THE INVENTION

The present invention utilizes the above technical idea of using a measuring wave to detect the state of motion of a moving object or a technical idea similar thereto and thereby provides an image forming device and a transfer device capable of implementing at least one of a function of stably controlling various transferring operations in both a paper transferring direction and a skew direction, a function of precisely diagnosing a fault of transfer-related components, and a function of precisely diagnosing deterioration of transfer-related components.

A transfer device according to the present invention is suitable for use, for example, in an image forming device wherein an image is formed on an object to be transferred such as printing paper on the basis of inputted image data, and can implement a function of monitoring a displacement in a transfer direction of a to-be-transferred object (e.g., printing paper) during transfer and a displacement in a skew direction orthogonal to the transfer direction and controlling the transfer operation on the basis of the result of the monitoring, and a function of performing predetermined error processing or warning processing in the event the result of monitoring exceeds a predetermined reference.

The image forming device and a transfer device used therein according to the present invention are provided with a drive mechanism unit including a roll member which causes an object to be transferred to move in a predetermined direction with a rotational force, a transfer direction displacement information acquiring unit which radiates a predetermined measuring wave toward the object to be transferred, detects a wave from the object to be transferred as a measured wave that corresponds to the measuring wave, and thereby acquires displacement information in a transfer direction of the object to be transferred which is moved by operation of the drive mechanism unit, a skew direction displacement information acquiring unit which radiates a predetermined measuring wave toward the object to be transferred, detects a wave from the object to be transferred as a measured wave that corresponds to the measuring wave, and thereby acquires displacement information in a skew direction substantially orthogonal to the transfer direction of the object to be transferred which is moved by operation of the drive mechanism unit, and a transfer processing unit which, on the basis of the displacement information in each of the transfer direction and the skew direction acquired by the transfer direction displacement acquiring unit and the skew direction displacement acquiring unit, performs predetermined processing in accordance with a state of transfer of the object to be transferred.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Embodiments of the present invention will be described in detail hereunder with reference to the accompanying drawings.

Figure 1:
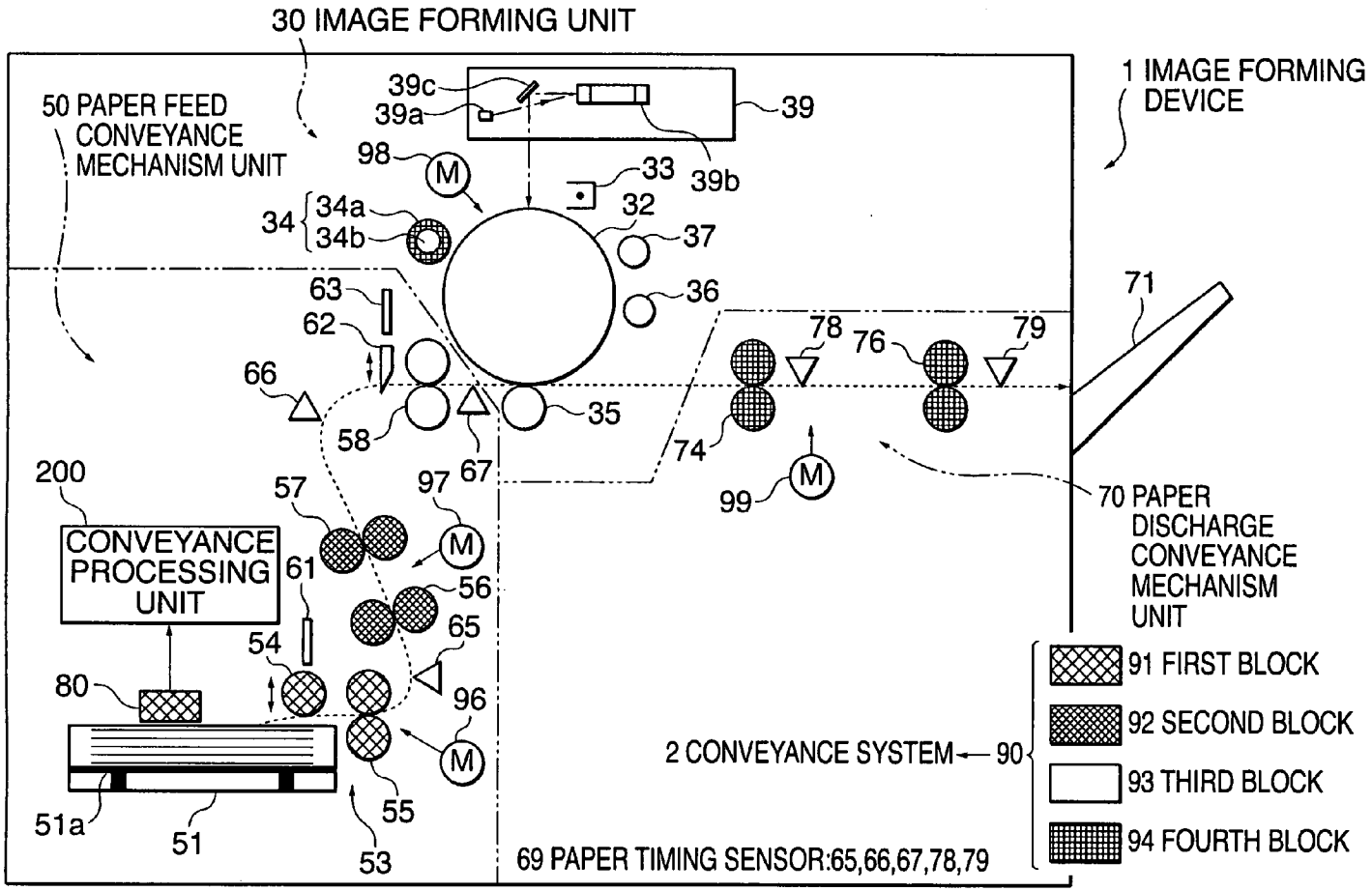
FIG. 1 illustrates a construction example of an image forming device on which is mounted a troubleshooting system according to an embodiment of the present invention.

FIG. 1 illustrates a construction example of an image forming device on which is mounted a troubleshooting system according to an embodiment of the present invention. The image forming device, indicated at 1, is a composite machine which is provided with an image reader (scanner) for reading an image of an original for example and which fulfills a copier function of printing an image corresponding to the original image on the basis of image data read by the image reader, a printer function of making print and output on the basis of printing data (image representing data) inputted from a personal computer for example, and a facsimile transmission/reception function which permits printing and outputting of a facsimile image. The image forming device 1 is constructed as a digital printer. FIG. 1 is a sectional view of a mechanical portion (hardware configuration) of the image forming device 1, taking note of a functional portion which transfers an image onto printing paper.

According to a broad classification, the illustrated image forming device 1 is provided with an image forming unit 30 which has a function of forming (printing and outputting) an image onto printing paper on the basis of inputted image data, a paper feed transfer mechanism unit 50 adapted to feed printing paper to a printing unit in the image forming unit 30, and a paper discharge transfer mechanism unit 70 adapted to discharge printing paper to the exterior of the system after image formation. These component units include roll parts which cause printing paper as an example of an object to be transferred in a predetermined direction with a rotational force.

On the basis of image data inputted from an image processing unit (not shown), the image forming unit 30 forms, i.e., prints and outputs, a visible image on printing paper such as ordinary plain paper or thermal paper by utilizing electrophotograph, thermal, thermal transfer, or ink jet recording method, or a similar conventional image forming process. For this operation, the image forming unit 30 is provided with, for example, a printing engine of a raster output scan (ROS) base which is for making the image forming device 1 operate as a digital printing system.

For example, a photosensitive drum roll 32 is arranged centrally of the image forming unit 30, and around the photosensitive drum roll 32 there are arranged a primary charger 33, a developing unit 34 made up of a developing roll 34*a* and a developing clutch 34*b*, a transfer roll 35, a cleaner roll 36, and a lamp 37. The transfer roll 35 is arranged in opposition to and in a pair with the photosensitive drum roll 32 so as to convey printing paper while sandwiching the paper in between the roll and the drum.

The image forming unit 30 is further provided with a write scanning optical system (hereinafter referred to as "laser scanner") for recording a latent image on the photosensitive drum roll 32 on the basis of image forming data. The laser scanner 39 as an optical system includes a laser 39*a* which modulates a laser beam L on the basis of image data inputted from a host computer (not shown) and outputs the modulated laser beam, as well as a polygon mirror (rotary polygon mirror) 39*b* and a reflecting mirror 39*c* for scanning the laser beam L outputted from the laser 39*a* onto the photosensitive drum roll 32.

The paper feed transfer mechanism unit 50 is made up of a paper feed tray 51 for transferring printing paper to the image forming unit 30, plural rolls which constitute a transfer path in a paper feed system, and plural paper timing sensors. As rolls used in the paper feed transfer mechanism unit 50 there are used a single roll and rolls of a pair structure wherein two rolls are arranged in opposition to each other to convey printing paper in a paper sandwiching fashion there between. For example, on the transfer path 52 there are arranged as roll parts, successively from the paper feed tray 51 side toward the image forming unit 30, a pickup roll 54, a pair of paper feed rolls 55, a pair of first transferring rolls 56, a pair of second transferring rolls 57, and a pair of third transferring rolls 58. A feed unit 53 is constituted by the pickup roll 54 and the pair of paper feed rolls 55.

A solenoid 61 for operating the pickup roll 54 is arranged near the pickup roll 54. In the vicinity of the pair of third transferring rolls 58 and on an upstream side (left side in the figure) of the same rolls on the transfer path 52 there are arranged a stop pawl 62 for temporarily stopping printing paper having been transferred on the transfer path 52 and a solenoid 63 for operating the stop pawl 62.

On the transfer path 52 there are arranged, as sensor parts, a first sensor 65 between the pair of paper feed rolls 55 and the pair of first transferring rolls 56, a second sensor 66 between the pair of second transferring rolls 57 and the pair of third transferring rolls 58, and a third sensor 67 between the pair of third transferring rolls 58 and the transfer roll 35.

The pair of paper feed rolls 55 not only function to guide printing paper to the first sensor 65 and the pair of first transferring rolls 56 but also fulfills a paper loosening function for preventing a lap feed (simultaneous feed of two or more sheets of paper). The pair of first transferring rolls 56 and the pair of second transferring rolls 57 fulfill a function for guiding printing paper to the photosensitive drum roll 32.

The solenoid 63 is used for once stopping printing paper with the stop pawl 62 upon lapse of a predetermined time after turning ON of the second sensor 66. This is done to take timing for aligning a write start position in printing paper with an image position on the photosensitive drum roll 32.

The paper discharge transfer mechanism unit 70 is made up of a paper discharge tray (outer tray) 71 for receiving, outside the device, printed paper on which images are formed in the image forming unit 30, plural rolls which constitute a transfer path 72 in a paper discharge system, and plural sensors. As rolls used in the paper discharge transfer mechanism unit 70 there are used rolls of a pair structure wherein two rolls are arranged in opposition to each other to convey printing paper while sandwiching the paper in between the rolls. For example, on the transfer path 72 there are arranged, as roll parts, a pair of fixing rolls 74 and a pair of discharge rolls 76 successively from the transfer roll 35 side in the image forming unit 30 toward the paper discharge tray 71.

Further, on the transfer path 72 there are arranged, as sensor parts, a fourth sensor 78 between the pair of fixing rolls 74 and the pair of discharge rolls 76 and a fifth sensor 79 between the pair of discharge rolls 76 and the paper discharge tray 71.

The sensors 65, 66, 67, 78, and 79 (hereinafter may also be referred to all together as "paper timing sensors 69") are paper detecting parts (paper timing sensors) which constitute a paper passing time detecting unit, and are installed to detect whether or not printing paper as an example of an object to be transferred is being transferred at a predetermined timing. Detected signals obtained by the sensors are inputted to a measuring unit (not shown) which measures printing paper transfer timing and transfer time (paper passing time).

As the paper timing sensors 69 serving as paper detecting parts there may be used paper timing sensors of various shapes and characteristics according to the place where they are installed. Basically there are used paper timing sensors each constituted by a pair of a light emitting element (e.g., a light emitting diode) and a light receiving element (e.g., a photo-diode or a photo-transistor). There may be used a photo-interrupter which is an integral combination of both light emitting element and light receiving element.

Each of the paper timing sensors 69 may be either a transmission type (also called cut-off type) or a reflection type. In the transmission type sensor, a light emitting element and a light receiving element are arranged in opposition to each other, and when printing paper is not transferred between the both elements, the light receiving element receives light from the light emitting element and turns ON, while when printing paper passes between both elements, the light from the light emitting element is intercepted by the printing paper and consequently the light receiving element turns OFF.

On the other hand, in the reflection type sensor, a light emitting element and a light receiving element are arranged in such a manner that light from the light emitting element is reflected by printing paper and the reflected light is incident on the light receiving element. When printing paper is not transferred, the light receiving element does not receive light from the light emitting element and turns OFF, while when printing paper is transferred, light from the light emitting element is reflected by printing paper and is incident on the light receiving element, so that the light receiving element turns ON. In the construction of this embodiment illustrated in FIG. 1, reflection type photo-interrupters are used for all of the paper timing sensors 69.

In connection with the passage timing of printing paper, if the time required from the time when the transfer of printing paper is started until the time when the printing paper passes each sensor is outside a predetermined time range, the image forming device 1 determines that a trouble has occurred in the printing paper transferring process and it is impossible to effect normal printing, then stops the transfer of printing paper at that time point and at that position. This is generally called jam. As examples of troubles in the paper transferring process there are mentioned wear and deterioration of the pickup roll 54, the pair of paper feed rolls 55, the pair of first transferring rolls 56, the pair of second transferring rolls 57, the pair of third transferring rolls 58, or the pair of discharge rolls 76, further, though not shown, troubles of motors 96 to 99 for driving roll parts or of drive circuits for driving those motors, breakage of driving gears, and a trouble of solenoid which controls the paper transfer timing. In connection with paper jam, a paper skew caused by wear and deterioration of rolls is a great factor.

Further, in connection with troubles in the paper transferring process, the feed unit 53 formed of the pickup roll 54 and the pair of paper feed rolls 55 is high in the frequency of trouble occurrences and in the frequency of component replacement caused by wear and deterioration of rolls. Since the first sensor 65 for detecting the state of operation of the feed unit 53 is installed in the construction of this embodiment, a deviation from a normal value of paper transfer can be detected in the first sensor 65. However, it is impossible to accurately detect such a state of operation of the pickup roll 54 and the pair of paper feed rolls 55 as is based on variations in the paper installed position within the paper feed tray 51.

In view of this point, in the image forming device 1, as a construction peculiar to this embodiment, a displacement information acquiring unit 80 is arranged at a position opposed to printing paper within the paper feed tray 51 to detect displacement information (e.g., movement quantity and moving velocity) in the printing paper transferring direction and in a skew direction approximately perpendicular to the paper transferring direction directly and simultaneously. The movement quantity and the moving velocity mean a relative movement quantity and a relative moving velocity, respectively, in a predetermined direction between the displacement information acquiring unit 80 and the printing paper.

A transfer device 2 is constituted by a drive mechanism unit 90 (blocks 91 to 94). The transfer device 2 is provided with a transfer processing unit 200 which, on the basis of displacement information acquired by a displacement information acquiring unit 80, performs predetermined processing according to the state of transfer of printing paper as an example of an object to be transferred. In order that a single motor can be utilized effectively, the drive mechanism unit 90 is constructed in such a manner that the power of the motor is transmitted in plural directions through gears, shafts, bearings, belts, and rolls. Within the image forming device 1, the drive mechanism unit 90 of such a construction is divided into plural blocks using drive motors (motors 96 to 99 in this embodiment) as operation units which drive motors serve as a base (master, power source) of the drive mechanism.

Solenoid and clutch are examples of drive parts, but since they function as switching mechanisms for other parts to which the driving force of the drive motors is transmitted, they are in a relation of slave to the drive motors. In this point they are also examples of power transfer parts like gears, shafts, bearings, and belts. This is why division is made into blocks with the drive motors as operation units. For example, in the illustrated image forming device 1, the drive mechanism unit 90 is divided into four blocks 91 to 94 and operates.

For forming an image on printing paper in the image forming device 1 constructed as above, first, upon start of printing, the solenoid 61 operates and pushes down the pickup roll 54. Nearly simultaneously with this operation, the motors 96 to 99 for rotating the rolls (roll pairs) in the image forming device 1 starts rotating. The pickup roll 54 depressed by the solenoid 61 comes into contact with the top printing paper in the paper feed tray 51 and guides one sheet of printing paper to the pair of paper feed rolls 55.

Upon lapse of a predetermined time after turning ON of the second sensor 66, the solenoid 63 causes the printing paper to be once stopped by the stop pawl 62. Thereafter, the solenoid 63 releases the stop pawl 62 at a predetermined timing at which the write start position in the printing paper and the position of an image on the photosensitive drum roll 32 are aligned with each other. As a result, the stop pawl 62 returns to its original position and the pair of third transferring rolls 58 convey the printing paper to between the photosensitive drum roll 32 and the transfer roll 35.

In the image forming unit 30, first, the laser 39*a* as a light source for forming a latent image is driven in accordance with image-forming data provided from a host computer (not shown), thereby converts the image data into a light signal and directs this converted laser beam L toward the polygon mirror 39*b*. Further, through the optical system including the reflecting mirror 39*c*, the laser beam L scans over the photosensitive drum roll 32 which is charged by the primary charger 33, thereby forming an electrostatic latent image on the drum roll 32.

The electrostatic latent image is made into a toner image by the developing unit 34 to which toner of a predetermined color (e.g., black) is fed, then this toner image is transferred onto the printing paper by the transfer roll 35 while the printing paper which has been transferred along the transfer path 52 passes between the photosensitive drum roll 32 and the transfer roll 35.

The toner and latent image remaining on the photosensitive drum roll 32 are cleaned and removed by the cleaner roll 36 and the lamp 37. The developing clutch 34*b* is attached to the developing roll 34*a* to adjust the development timing.

The printing paper with the toner transferred thereto is then heated and pressurized by the pair of fixing rolls 74, whereby the toner is fixed to the printing paper. Lastly, by the pair of discharge rolls 76, the printing paper is discharged to the paper discharge tray 71 which is arranged outside the image forming device.

The construction of the image forming unit 30 is not limited to the above construction. For example, there may be adopted an IBT (Intermediate Belt Transfer) structure provided with one or two intermediate transfer belts. Further, although the illustrated image forming unit 30 is for monochromatic printing, it may be constructed as an image forming unit 30 for color printing. In this case, as the construction of the engine portion there may be adopted, for example, either a multi path type (cycle type/rotary type) construction wherein the same image forming process is repeated for each of output colors K, Y, M, and C to form color images, for example, images of the colors are formed successively by a single engine (photoreceptor unit) and at the same time the images are lap-transferred color by color onto an intermediate transfer member to form a color image, or a tandem type construction wherein plural engines corresponding respectively to output colors are arranged inlinewise like K→Y→M→C for example and images of K, Y, M, and C are processed in parallel (concurrently) by means of four engines.

Figure 2:
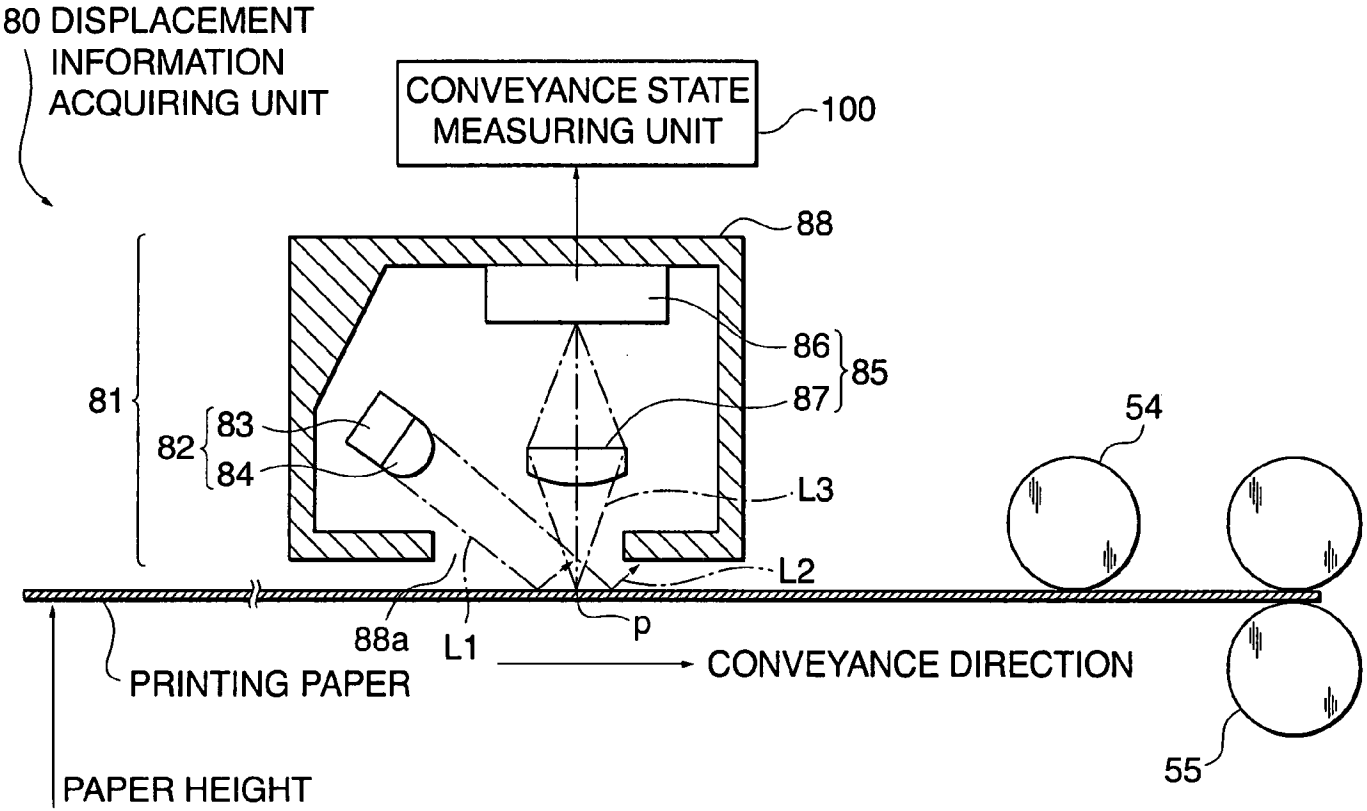
FIG. 2 illustrates a first construction example of a displacement information acquiring unit used in the image forming device illustrated in FIG. 1.

FIG. 2 illustrates a first construction example of the displacement information acquiring unit 80 used in the image forming device 1 shown in FIG. 1. Like FIG. 1, FIG. 2 illustrates a sectional construction in the vicinity of the displacement information acquiring unit 80 which is arranged above the printing paper in the paper feed tray 51. It is assumed that the printing paper is transferred from the left to the right in the figure. That is, the direction from the left to the right is a printing paper transferring direction and the depth direction in the figure is a skew direction.

The displacement information acquiring unit 80 of the first example is characterized in that a structural feature appearing on the surface of an object is observed by a photo-detector array and thereby determines the position and motion of the object.

As shown in FIG. 2, the displacement information acquiring unit 80 of the first example is provided with a transfer state monitoring unit 81 which monitors displacement in both the printing paper transferring direction and the skew direction and a transfer state measuring unit 100 which determines an index value on the state of printing paper transfer on the basis of the displacement information obtained by the transfer state monitoring unit 81.

The transfer state monitoring unit 81 has a light source unit 82 which radiates illumination light L1 as an example of a measuring wave to printing paper as an object to be measured and a light receiving unit 85 which received reflected light as an example of measured wave after reflection at a printing paper measuring point p (applied point of the illumination light L1). The light source unit 82 and the light receiving unit 85 are accommodated within a housing 88 so that respective optical axes satisfy a predetermined relation and so as not to be influenced by extraneous light. An aperture 88*a* is formed in part of a surface of the housing 88 opposed to the paper feed tray 51 so that the illumination light L1 emitted from the light source unit 82 is applied to the printing paper measuring point p.

The light source unit 82 is provided with a light emitting element 83 as an example of an illumination source and an illuminating optical system 84 which shapes the illumination light L1 emitted from the light emitting element 83 into a predetermined shape and conducts it to the printing paper measuring point p. The light receiving unit 85 is provided with a two-dimensional movement quantity detecting sensor 86 having a sensor element for receiving reflected light and is also provided with a light receiving optical system which includes as a principal component a focusing lens 87 for focusing reflected light onto the sensor element of the two-dimensional movement quantity detecting sensor 86. The focusing lens 87 is mounted in such a manner that one focal plane thereof (a plane perpendicular to an optical axis including a focal point) is opposed to the surface of printing paper and the other focal plane thereof is opposed to a light receiving surface of the sensor element in the two-dimensional movement quantity detecting sensor 86.

Regarding how to handle the reflection of light, there are various methods. In this embodiment, the reflection of light is handled in the following manner. First, the reflection of light can be classified into a component (surface reflection component) having a high degree of contribution to gloss which reflects at an object surface and a component (internal reflection component) having a high degree of contribution to color (lightness and saturation) which reflects in the interior of an object surface. When viewed from the standpoint of reflection angle, the reflection of light can be classified into a specular reflection component which conforms to such a reflection law as specular reflection when seen macroscopically on a reflection surface and a scattered reflection (also called irregular reflection) component as a reflection component which scatters in directions other than a specular reflection angle on a reflection surface.

If both surface reflection component and internal reflection component emitted from a light source and reflected by an object are received at the same light receiving angle, it is impossible to distinguish them strictly from each other, but the specular reflection component and the scattered reflection component classified from the standpoint of reflection angle can be distinguished from each other. The specular reflection component reflects the degree of gloss of a measured object, so in point of monitoring the state of transfer of an object it is considered preferable to receive the scattered reflection component which is less influenced by the gloss.

In the construction of this example, therefore, out of a specular reflection component L2 and a scattered reflection component L3 both reflected at the measuring point p, the scattered reflection component L3 is received by the light receiving unit 85. More specifically, the light receiving element 83 is arranged in θ direction of the normal line of printing paper, while the diffuse reflection light receiving unit 34 for receiving the scattered reflection component L3 is arranged in the normal line direction. The normal line direction indicates a position just above the measuring point p of the printing paper as an object to be measured. In this construction, a θ° incidence-0° reception system is used for detecting the scattered reflection component L3. For example, the angle (incidence angle θ) is preferably selected so as to provide a grazing angle illumination of 16° or less. Further, it is preferable to install the light emitting element 83 so that it can be fixed to a predetermined position or install it movably so that the incidence angle θ can be adjusted as necessary. This angle is set at an angle of a center line of a divergent or convergent beam.

In the case of using the two-dimensional movement quantity detecting sensor 86 for the purpose of monitoring the state of transfer of printing paper in the paper feed tray 51 as in this example, it is preferable to provide a mechanism which makes control so that one focal plane of the focusing lens 87 is always coincident with the surface of printing paper even if the paper volume in the paper feed tray 51 changes.

In this case, there may be adopted, for example, a construction wherein a sensor having a slippery member at a lower position thereof, like an optical mouse sensor, is installed within the paper feed tray and the slippery member is brought into light contact with printing paper by the own weight of the two-dimensional movement quantity detecting sensor.

The two-dimensional movement quantity detecting sensor 86 may be fixed and the top paper height in the paper feed tray 51 may be controlled so as to be kept constant. The height of the two-dimensional movement quantity detecting sensor 86 and the position in the optical axis direction of the focusing lens 87 may be controlled (equal to focus adjustment) to match the paper height which becomes lower as the printing paper is used. In the latter case, it is preferable to also control the irradiation angle of the light emitting element 83 in such a manner that the illumination light L1 is applied to the printing paper measuring point p as seen from the light receiving unit 85 side. In the case where the height of the pickup roll 54 is unchangeable, the displacement information acquiring unit 80 may be arranged near the pickup roll 54 to diminish the influence of the amount of printing paper used.

Anyway, it is preferable to provide a mechanism which permits the two-dimensional movement quantity detecting sensor 86 to surely receive the scattered reflection component L3 reflected at an irradiation point z of the illuminating light L1 emitted from the light emitting element 83, without being influenced by a change in the amount of printing paper used. In this embodiment, as shown in FIG. 1, a paper height maintaining mechanism 51*a* for keeping the top paper height in the paper feed tray 51 always constant is arranged within the paper feed tray 51.

The paper timing sensors 69 may be substituted by the displacement information acquiring unit 80. In this case, since the printing paper being transferred can oscillate in a direction (surface-back direction in the figure) which is orthogonal to both the paper transferring direction and the skew direction, there occurs a change of the distance between the printing paper and the two-dimensional movement quantity detecting sensor 86. However, that change is much smaller than the change in the amount of printing paper used in the paper feed tray 51 and may be considered negligible. But if the oscillation poses a problem, there may be adopted the same countermeasure as that shown above in the case of disposing the transfer state monitoring unit 81 above the paper feed tray 51.

The purpose of illuminating the surface of printing paper by the illumination light L1 is to create a contrast of light which represents a structural feature or a printing feature on the paper surface. The focusing lens 87 is provided for the purpose of collecting and focusing light energy from the printing paper surface to the two-dimensional movement quantity detecting sensor 86 with use of the transfer state monitoring unit 81. The focusing lens 87 collects light which has been reflected, scattered, transmitted, or released from the printing paper surface and focusing the thus-collected light onto a sensor element in the two-dimensional movement quantity detecting sensor 86. The distance from the focusing lens 87 to the printing paper surface and the distance from the focusing lens 87 to the two-dimensional movement quantity detecting sensor 86 are determined by a lens which is selected for a specific use and for a required magnification.

The transfer state monitoring unit 81 focuses the contrast of illumination light L1 onto the two-dimensional movement quantity detecting sensor 86 and uses it as a landmark in a time series of image. During the period for acquiring the time series, the transfer state monitoring unit 81 measures a relative movement (i.e., velocity and travel) between the two-dimensional movement quantity detecting sensor 86 and the printing paper. For example, the two-dimensional movement quantity detecting sensor 86 is constituted by plural sensor elements each having an individual optical sensitivity. The pitch of the sensor elements in the two-dimensional movement quantity detecting sensor 86 exerts an influence on the resolution of an image capable of being formed by the sensor 86 in association with the magnification of the focusing lens 87. For the array of the sensor elements there may be adopted, for example, a CCD (Charge Coupled Device) array, an amorphous silicon photo-detector array, a MOS (Complementary Metal-oxide Semiconductor) photo-detector array, or any of various other similar types of active pixel sensor arrays.

Figure 3:
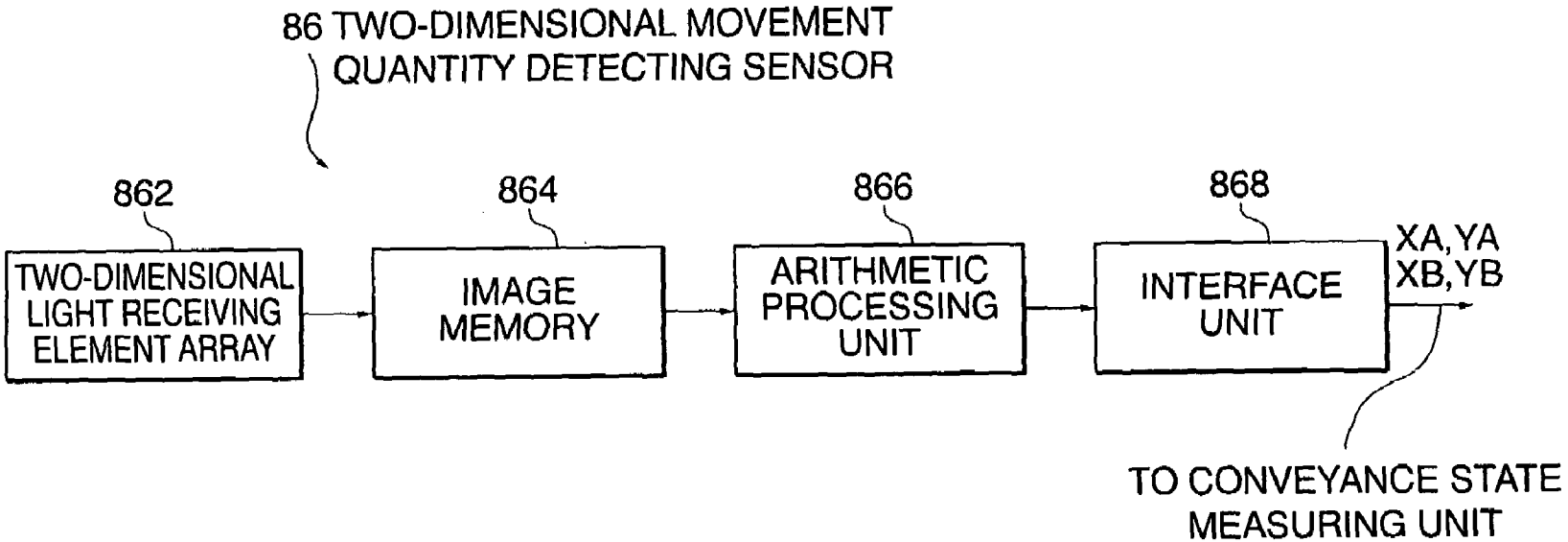
FIG. 3 is a functional block diagram showing a construction example of a two-dimensional movement quantity sensor arranged in a first example of a transfer state monitoring unit.
Figure 4:
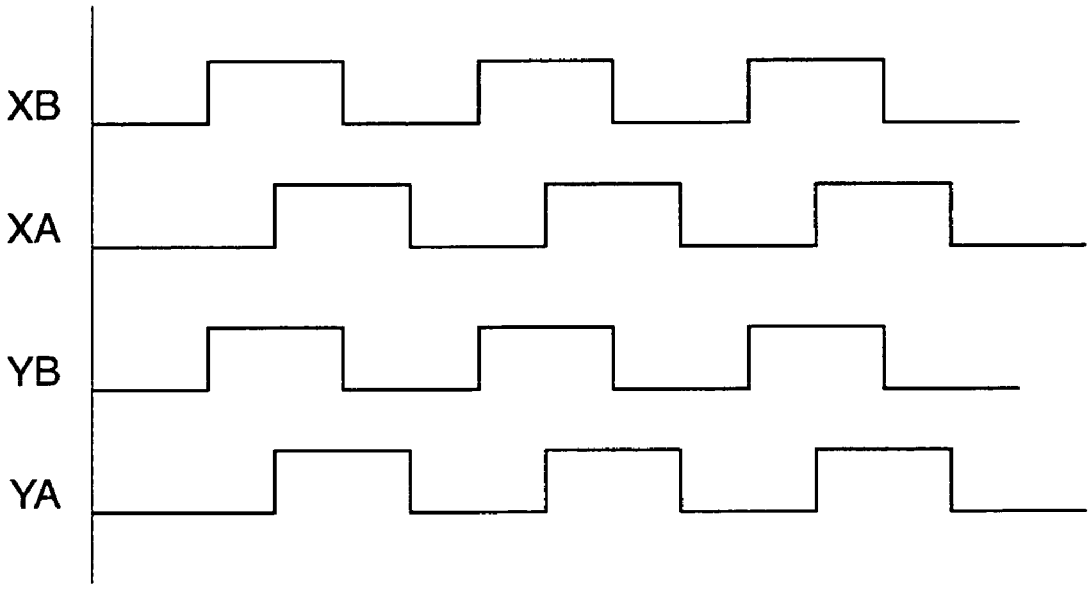
FIG. 4 shows an example of a signal pattern outputted from the two-dimensional movement quantity sensor.

FIG. 3 is a functional block diagram showing a construction example of the two-dimensional movement quantity detecting sensor 86 arranged in the first example of the transfer state monitoring unit 81, and FIG. 4 illustrates an example of signal patterns outputted from the two-dimensional movement quantity detecting sensor 86. As the two-dimensional movement quantity detecting sensor 86 arranged in the first example of the transfer state monitoring unit 81 there was used HDNS2000 manufactured by Agilent Technologies Co., U.S. The two-dimensional movement quantity detecting sensor 86 is constructed as a two-dimensional motion sensor in two reference-axis directions of x axis direction and y axis direction orthogonal thereto, wherein the scattered reflection component L3 is detected in the two reference-axis directions. The two-dimensional movement quantity detecting sensor can detect a paper moving speed of up to 300 mm/sec.

As shown in FIG. 3, the two-dimensional movement quantity detecting sensor 86 has a two-dimensional light receiving element array (an array of photo-detectors in two dimensions) 862, an image memory 864 which temporarily stores information detected by the two-dimensional light receiving element array 862, an arithmetic processing unit 866, and an interface unit 868 which outputs information indicative of a movement quantity obtained by the arithmetic processing unit 866.

In HDNS2000 used as the two-dimensional movement quantity detecting sensor 86, there are two modes which are a PS/2 output mode for personal computers and quadrature output mode. In this embodiment there is used the quadrature output mode. In this case, as shown in FIG. 4, four signals, which are phase difference pulse trains XA, XB in x direction and phase difference pulse trains YA, YB in y direction, are outputted simultaneously from corresponding four signal output terminals in the interface unit 868.

The arithmetic processing unit 866 may be constituted not only by hardware but also software-wise using a computer and on the basis of a program code which implements that function. The computer may be provided with an electronic or magnetic memory, a microprocessor, an ASIC (Application Specific Integrated Circuit: IC for specific use), and a DSP (Digital Signal Processor). By execution using software, there accrues an advantage that the processing procedure can be changed easily without the need of changing hardware.

The two-dimensional movement quantity detecting sensor 86 observes a structural feature focused by a photo-detector array (two-dimensional array in this example) of plural detectors which detects the scattered reflection component L3 as a wave to be measured, and determines the position and motion of an object (printing paper in this example) on the basis of movement of the structural feature present within the visual field of the photo-detector array. For example, a fine structure of the printing paper surface is detected at a predetermined timing by the two-dimensional light receiving array 862 and is stored as first image data in the image memory 864. At the next timing, a fine structure after a fine movement of the printing paper is detected by the two-dimensional light receiving element array 862 and is used as second image data. The arithmetic processing unit 866 performs pattern matching processing or double correlation processing between the second image data and the first image data stored in the image memory 864 and indicative of the fine structure detected at the previous timing, thereby calculating a movement quantity of printing paper.

As to the principle of thus utilizing a structural feature appearing on the surface of an object and determining the position and motion of the object. An explanation thereof will here be omitted.

The arithmetic processing unit 866 converts the movement quantity thus calculated into phase difference pulse trains XA, XB in x direction and YA, YB in y direction which are shown in FIG. 4, and outputs them through the interface unit 868. In each of them, the movement quantity is represented by the number of pulses. In HDNS2000, one pulse corresponds to a movement quantity of about 0.23 mm.

FIG. 4 shows the case where printing paper has moved relatively in +x and +y directions with respect to the two-dimensional movement quantity detecting sensor 86 (the two-dimensional light receiving element array 862). In this case, as shown in the same figure, as to the phase difference pulse trains XA and XB indicative of movement quantity in x direction, XA is in a relation of 90° phase lag to XB. Also as to the pulse trains YA and YB indicative of movement quantity in y direction, YA is in a relation of 90° phase lag to YB. Conversely to the illustrated case, if XB is in a relation of 90° phase lag to YB or if YB is in a relation of 90° phase lag to YA, opposite moving directions are represented, that is, printing paper is moving relatively in −x direction or −y direction with respect to the two-dimensional movement quantity detecting sensor 86.

Figure 5A:
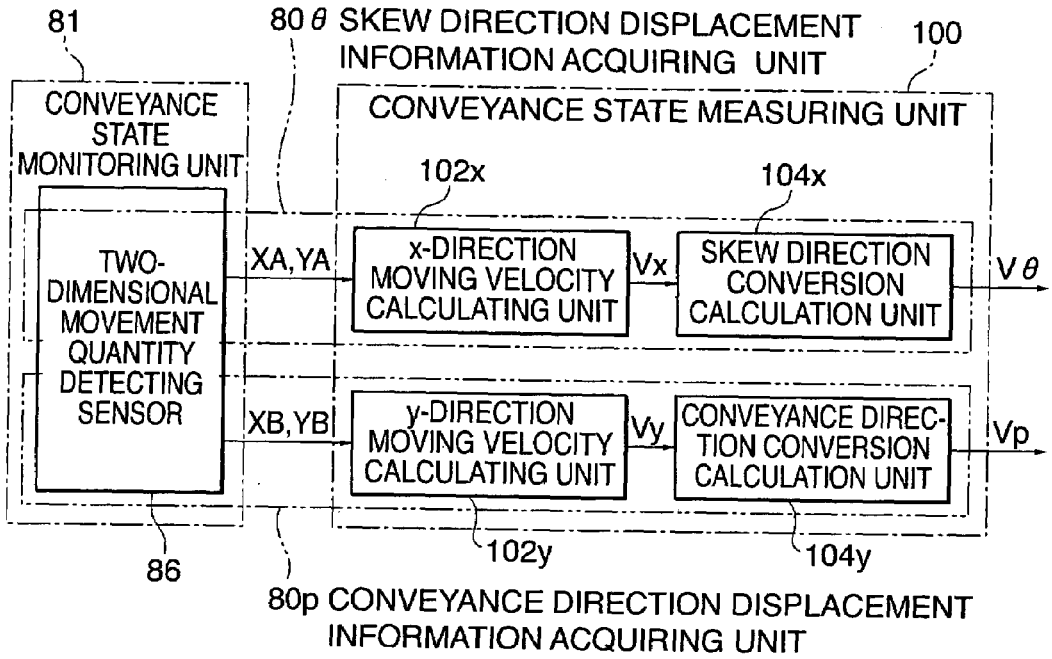
FIG. 5 illustrates the operation of a transfer state measuring unit.
Figure 5B:
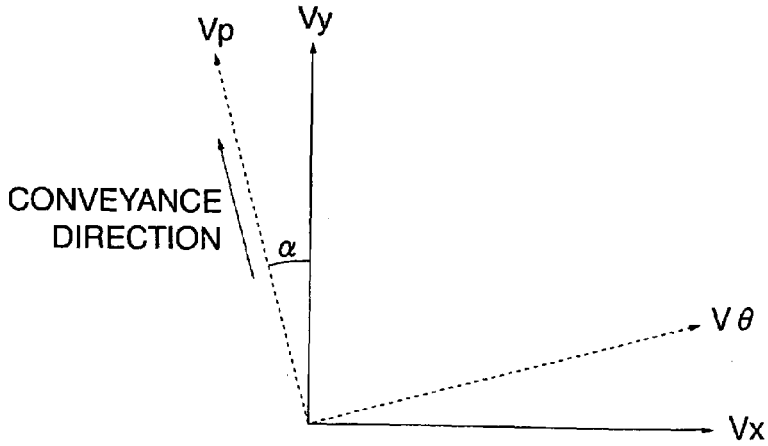

FIG. 5 illustrates the operation of the transfer state measuring unit 100, in which FIG. 5A is a detail block diagram showing a construction example of the transfer state measuring unit 100 and FIG. 5B illustrates what influence is exerted by crossing, $\alpha$, between the printing paper transferring direction or skew direction and the mounting position of the two-dimensional movement quantity detecting sensor 86. A description will be given below on the assumption that in this embodiment the two-dimensional movement quantity detecting sensor 86 is installed so as to make +y direction correspond to a paper transferring direction and ±x direction correspond to a skew direction orthogonal to the paper transferring direction.

The transfer state measuring unit 100 has an x-direction moving velocity calculating unit 102*x* which determines a moving velocity Vx per unit time $\Delta t$ on the basis of signals XA and XB outputted from the two-dimensional movement quantity detecting sensor 86 in relation to x direction, a y-direction moving velocity calculating unit 102*y* which determines a moving velocity Vy per unit time $\Delta t$ on the basis of signals YA and YB outputted from the two-dimensional movement quantity detecting sensor 86 in relation to y direction (both calculating units will together be referred to as the moving velocity calculating unit 102), and a conversion calculation unit 104 which, on the basis of a deviation (tolerance α) between two reference-axis directions such as x- and y-axis directions and the printing paper transferring direction or skew direction, converts moving velocities in plural axis directions which the moving velocity calculating unit 102 has calculated in accordance with displacement information obtained by the two-dimensional movement quantity detecting sensor 86, into moving velocities in the paper transferring direction skew direction, that is, corrects a deviation between two reference-axis directions and actual paper transferring direction or skew direction.

The conversion calculation unit 104 has a skew direction conversion calculation unit 104*x* which performs conversion calculation for the moving velocity Vx in the x-axis direction to determine a moving velocity Vθ in the skew direction and a transfer direction conversion calculation unit 104*y* which performs conversion calculation for the moving velocity Vy in the y-axis direction to determine a moving velocity Vp in the transfer direction. According to this construction, moving velocities Vp and Vθ in the transfer direction and skew direction after the correction of a mounting position error of the two-dimensional movement quantity detecting sensor 86 with respect to actual transfer direction and skew direction are outputted as index values on the state of transfer of printing paper from the transfer state measuring unit 100.

The signals XA, XB, YA, and YB from the two-dimensional movement quantity detecting sensor 86 are inputted to the transfer state measuring unit 100. On the basis of the signals XA, XB, YA, and YB provided from the two-dimensional movement quantity detecting sensor 86, the transfer state measuring unit 100 determines a paper transfer quantity for a predetermined unit time Δt (e.g., 200 msec) and then, from the paper transfer quantity thus determined, calculates a paper transfer velocity Vp in the transfer direction and a skew quantity Vθ as a paper transfer velocity in the skew direction. In the transfer state monitoring unit 81 and the transfer state measuring unit 100, a system for determining the moving velocity Vp in the transfer direction is a transfer direction displacement information acquiring unit 80*p*, while a system for determining the moving velocity Vθ in the skew direction is a skew direction displacement information acquiring unit 800.

If the number of pulses of XA and XB per unit time Δt in x direction is assumed to be PX, the speed Vx is represented by the following equation (1—1). Likewise, if the number of pulses of YA and YB per unit time Δt in y direction is assumed to be NPY, the speed Vy is represented by the following equation (1-2). In accordance with the equation (1—1) the x-direction moving velocity calculating unit 102*x* determines the moving velocity Vx in x-axis direction, while the y-direction moving velocity calculating unit 102*y* determines the moving velocity Vy in y-axis direction in accordance with the equation (1-2):

$$Vx=NPX/\Delta t \quad (1—1)$$

$$Vy=NPY/\Delta t \quad (1\text{-}2)$$

In the case where the y direction in the two-dimensional movement quantity detecting sensor 86 is established accurately with respect to the paper transferring direction, the speed Vy in y direction detected from YA and YB serves as it is as the paper transferring velocity Vp, while the velocity Vx in x direction detected from XA and XB serves as it is as the skew quantity Vθ.

Actually, however, the direction established in the two-dimensional movement quantity detecting sensor 86 has a tolerance α with respect to the paper transferring direction, as shown in FIG. 5B. Therefore, if the velocity Vx in x direction detected from XA and XB and the velocity Vy in y direction detected from YA and YB are used as they are, there results an error. Under the circumstances, the conversion calculation unit 104 in the transfer state measuring unit 100 corrects the establishment error for the moving velocities Vx and Vy in the x- and y-axis directions calculated by the moving velocity calculating unit 102 on the basis of the measured XA, XB, YA, and YB and in accordance with the equations (2-1) and (2—2) and thereby calculates highly accurate paper transferring velocity Vp and skew quantity Vθ. The skew direction conversion calculation unit 104*x* determines the moving velocity Vθ in the skew direction in accordance with the following equation (2-1), while the transfer direction conversion calculation unit 104*y* determines the moving velocity Vp in the transfer direction in accordance with the following equation (2—2):

$$V\theta=Vx^*\cos\alpha+Vy^*\sin\alpha \quad (2\text{-}1)$$

$$Vp=-Vx^*\sin\alpha+Vy^*\cos\alpha \quad (2—2)$$

Figure 6:
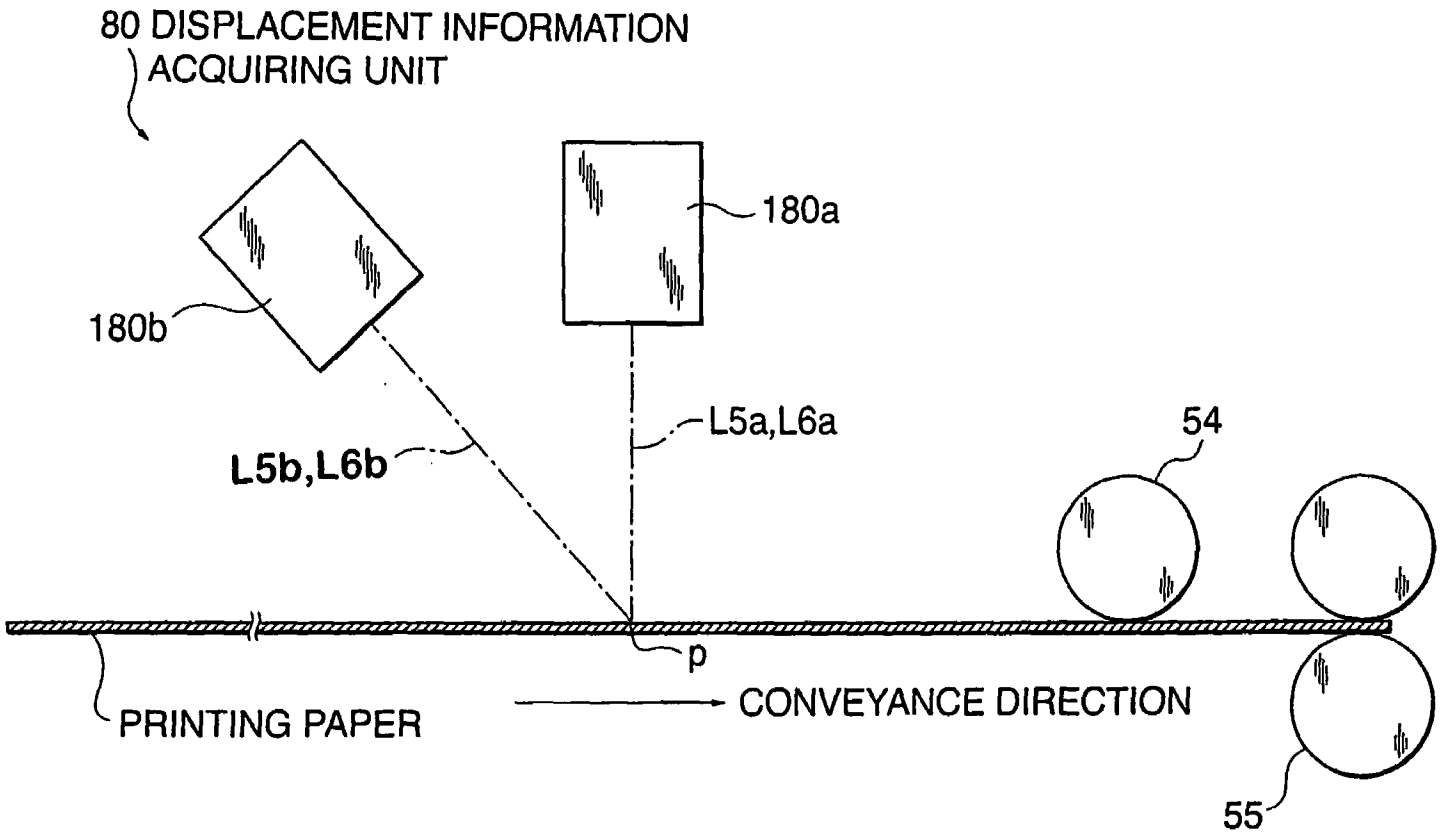
FIG. 6 illustrates a second construction example of a displacement information acquiring unit used in the image forming device illustrated in FIG. 1.

FIG. 6 illustrates a second construction example of the displacement information acquiring unit 80 used in the image forming device 1 shown in FIG. 1. In FIG. 6, like FIG. 1, there is shown a sectional configuration of the transfer state monitoring unit 81 which is installed above the printing paper in the paper feed tray 51. The transfer state monitoring unit 81 in this second example is characterized by measuring the moving velocity of a moving object by utilizing what is called the Doppler effect such that when a measuring wave such as light or radio wave is applied to a moving object, the frequency of a measured wave (e.g., scattered light) from the moving object shifts in proportion to the moving speed.

As shown in FIG. 6, the displacement information acquiring unit 80 in this second example is provided with two laser Doppler velocity meters 180 (respectively indicated at 180*a* and 180*b*). The laser Doppler velocity meters 180*a* and 180*b* radiate laser beams L5 (respectively indicated at L5*a* and L5*b*) as measuring waves to printing paper as an object to be measured and detect Doppler-shifted, scattered light beams L6 (L6*a* and L6*b*) as measured waves from the printing paper which correspond to the laser beams L5*a* and L5*b*, thereby detecting displacement information of the printing paper which is moving. The Doppler velocity meters 180*a* and 180*b* are installed above the printing paper in the paper feed tray 51 in such a manner that the laser Doppler velocity meter 180*a* can measure the velocity in the paper transferring direction and the laser Doppler velocity meter 180*b* can measure the velocity in a direction orthogonal to the paper transferring direction, i.e., in the skew direction.

The printing paper transferring velocity is calculated by the following equation (3), assuming that a Doppler shift is ΔfD, light velocity is c, and the frequency of laser beam is f:

$$V=\Delta fD^*c/f \quad (3)$$

<Construction Example of a Laser Doppler Velocity Meter>

Figure 7:
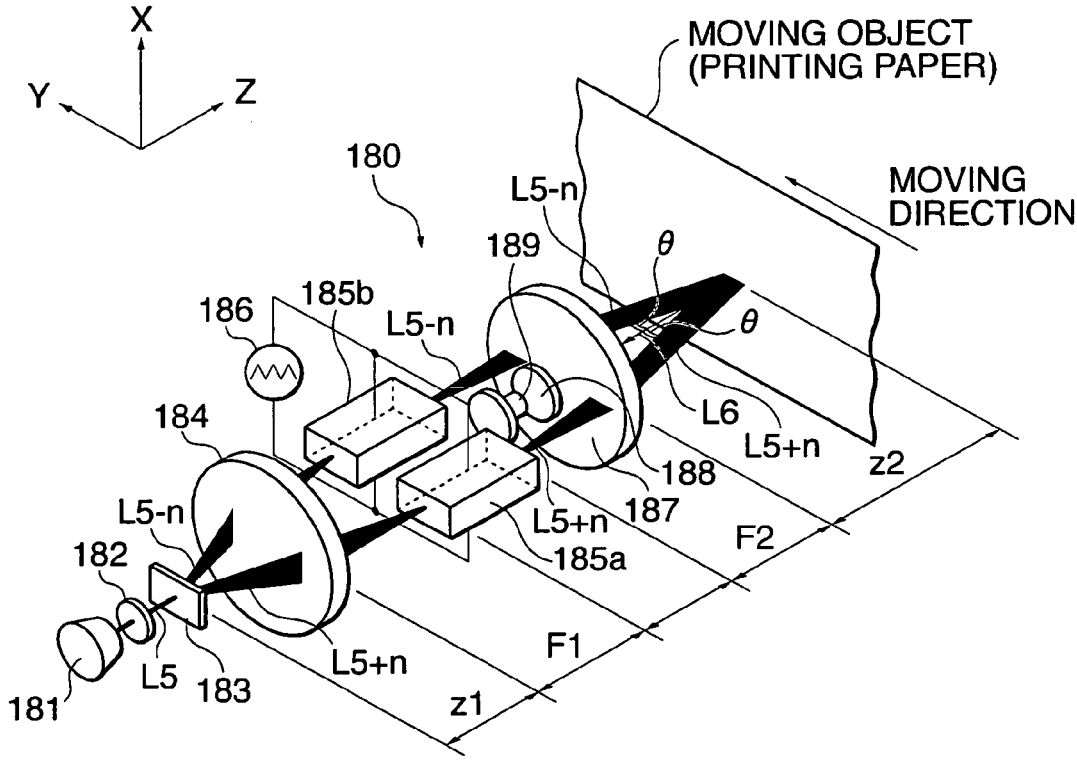
FIG. 7 is a schematic diagram of a principal portion, showing a construction example of a laser Doppler velocity meter arranged in the second example of the displacement information acquiring unit.

FIG. 7 is a schematic diagram of a principal portion, showing a construction example of the laser Doppler velocity meter 180 arranged in the displacement information acquiring unit 80 of the second example. More specifically, as laser Doppler velocity meter 180 in question there was used a laser Doppler velocity meter LV-20Z manufactured by CANON INC.

This laser Doppler velocity meter 180 is not only a diffractive laser Doppler velocity meter of the type wherein a laser beam emitted from a laser beam source is divided into two light beams by means of a diffraction grating and measurement is made using the two light beams, but also a laser Doppler velocity meter of the type wherein a predetermined frequency difference (frequency modulation) is applied between the two light beams with use of an electro-optical element which constitutes a frequency shifter and velocity information of a moving object is detected with a high accuracy by utilizing Doppler effect. The laser Doppler velocity meter 180 can detect a paper moving velocity of up to 2000 mm/sec and can cover a detection range from a stationary state up to a high velocity by the introduction of an electro-optical frequency shifter. In this point it is suitable for use in the high-velocity image forming device 1.

A semiconductor laser 181 as a light source part is arranged in such a manner that a laser beam L5 emitted from the semiconductor laser 181 is linearly polarized in the direction of Y axis (a skew direction orthogonal to the printing paper transferring direction) as a coordinate axis shown in FIG. 7. The laser beam L5 from the semiconductor laser 181 is collimated by a collimator lens 182 and is incident on a transmission type diffraction grating 183 perpendicularly to the grating array direction of diffracted light beams obtained from the diffraction grating 183, two diffracted light beams L5+n and L5−n of +n order and −n order other than 0 order exit with a predetermined diffraction angle and are incident on incident end faces of electro-optic elements 185 (185*a* and 185*b* respectively) via a focal optical system 184 which is spaced an optical distance z1 from the diffraction grating 183. As the focal optical system 184 there is used, for example, a thin convex lens having a predetermined focal distance F1.

The electro-optic elements 185 are flat plates of electro-optic crystals and are each arranged so as to have an optical axis in X axis. Electrodes (not shown) are provided at both end faces in X-axis direction and a sawtooth voltage is applied to the electrodes from a drive circuit 186. An electro-optic frequency shifter is constituted by the electro-optic elements 185 and the drive circuit 186. The two light beams L5+n and L5−n incident on the electro-optic elements 185 undergo a frequency shift by sawtooth voltage drive (serrodyne drive) of the electro-optic elements 185*a* and 185*b* and are incident on a focal optical system 187 in a state in which a frequency difference is thereby applied between the two light beams L5+n and L5−n. In the focal optical system 187, the two light beams are deflected at a predetermined angle and are made into parallel beams of light, which are applied in two directions to the surface of a moving object (printing paper in this example) so as to cross each other at a predetermined incidence angle θ, the moving object moving in Y direction at a predetermined velocity and at a distance spaced an optical distance z2 from the focal optical system 187. As the focal optical system 187 there is used, for example, a thin convex lens having a predetermined focal distance F2. By setting an optical distance between the exit end faces of the electro-optic elements 185 and the focal optical system 187 to the focal distance F2, collimated light beams L5+n and L5−n are exited from focal optical system 187.

A photo-detector 189, which is constituted by a photodiode, is arranged on the side opposite to the printing paper with respect to the focal optical system 187. Of the light beams incident on the printing paper, scattered light beams L6 generated from the printing paper pass through both the focal optical system 187 and a condenser lens 188 and are detected by the photo-detector 189. Through the focal optical systems 187 and 188, light signals containing Doppler signals are condensed to the photo-detector 189 efficiently.

The frequencies of the scattered light beams L6 based on the two light beams L5+n and L5−n undergo a Doppler shift in proportion of the moving velocity V and interfere with each other on a detection surface of the photo-detector 189, giving rise to a light/shade change. At this time, a light/shade frequency, i.e., Doppler frequency DF, can be determined by the following equation (4), assuming that the laser beam wavelength is λ and the difference in frequency between the two light beams is fR:

$$DF=2*V*\sin\theta/\lambda+fR \tag{4}$$

Thus, by introducing an electro-optic frequency shifter and by setting the frequency difference fR at an appropriate value, even a low printing paper moving velocity V, or even a stationary state involving a nearly zero moving velocity, can be measured and a velocity direction thereof can also be measured. Further, if a diffraction angle of light beams of ±n order other than 0 order is assumed to be θ0 when laser beams are incident on the transmission type diffraction grating 183 with a lattice pitch of d, there is obtained a relationship of the following equation (5):

$$\sin c\theta 0=\pm n*\lambda/d \tag{5}$$

In this connection, if a certain correlation is established between the angle θ of incidence of the two light beams L5+n and L5−n on the printing paper, a basic component DF0 of the Doppler frequency exclusive of the frequency difference fR can be obtained as a component proportional to only the moving velocity V and eventually the Doppler frequency DF can also be obtained as a frequency proportional to only the moving velocity V. For example, if the two light beams are radiated in such a manner that the incidence angle θ becomes θ0, then from the equations (4) and (5), the basic component DF0 becomes such a component as is represented by the following equation (6-1) and eventually the Doppler frequency DF obtained by the photo-detector 189 becomes such a frequency as is represented by the following equation (6-2):

$$DF0=2*V*\sin\theta 0/\lambda=2*n*V/d \tag{6-1}$$

$$DF=2*n*V/d+fR \tag{6-2}$$

Thus, since the laser beam emitted from the laser beam source is divided into two light beams by the diffraction grating and measurement is made using the two light beams, there no longer is any influence of a change in wavelength λ. Consequently, even if such a semiconductor laser as a laser diode having a temperature dependence of wavelength λ and being less expensive, ultra-small-sized and easy to drive is used as a light source, the velocity V of a moving object can be determined quite accurately.

As is the case with the array accuracy of the two-dimensional movement quantity detecting sensor, since the laser Doppler velocity meters 180 are installed with tolerance with respect to the paper transferring direction, the transfer state measuring unit 100 corrects an installation error in accordance with the equations (2-1) and (2—2) and thereby calculates highly accurate paper transferring velocity Vp and skew quantity Vθ.

The laser Doppler velocity meter 180*b* is arranged in an oblique irradiation relation. In the case of determining an absolute quantity of velocity, an oblique irradiation arrangement requires correction relative to an incidence angle, but there will be no problem if evaluation is made in terms of a relative value. A detailed explanation thereof will here be omitted. Further details can be obtained by making reference to, for example, "Electronic Measurement Lecture Contents (6.25) 7—7; Measuring Velocity with Laser Beam (Laser Doppler Velocity Meter)" [searched Jul. 1, 2002], Internet <URL:http://www.ecs.shimane-u.ac.jp/nawate/lecture/inst/6-25/6-25.html>.

Figure 8:
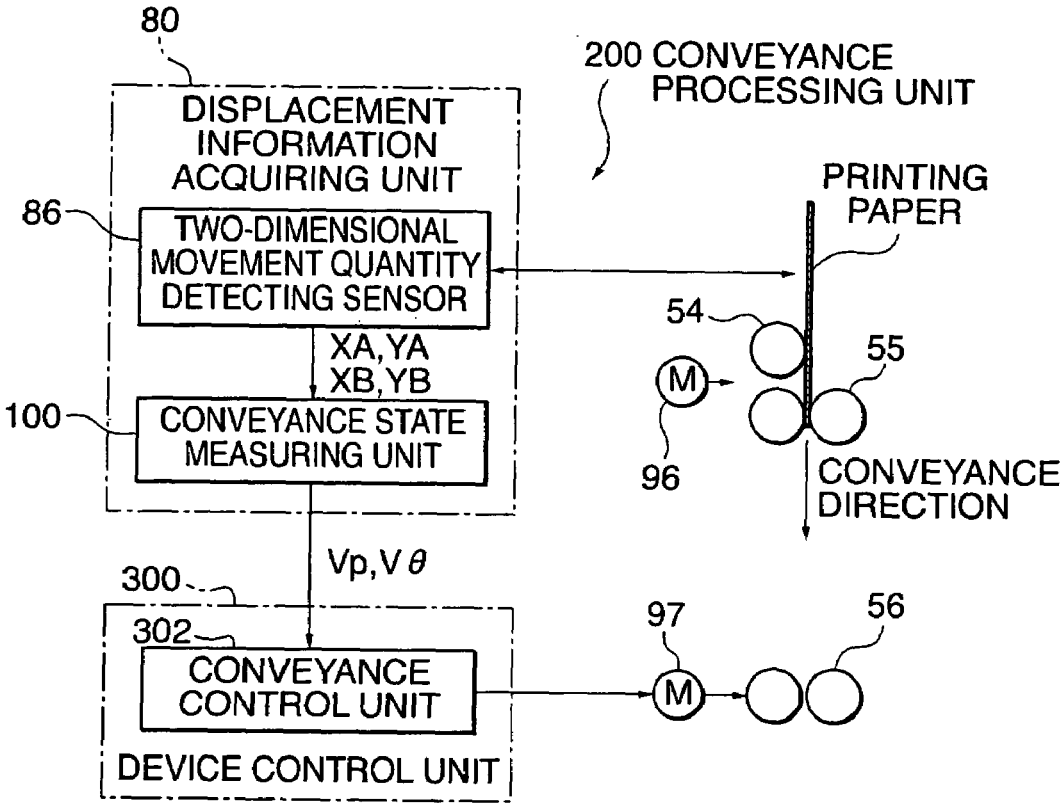
FIG. 8 illustrates the function of a transfer processing unit which controls a transfer operation on the basis of a monitoring result in the transfer state monitoring unit.

FIG. 8 illustrates the function of a transfer processing unit 200 which controls a transfer operation of the drive mechanism unit 90 in the image forming device 1 on the basis of the result of monitoring performed by the transfer state monitoring unit 81. Here, as is the case with FIG. 1, a description will be given about monitoring the state of operation of the feed unit 53 by the displacement information acquiring unit 80 and controlling the transfer operation of the drive mechanism unit 90 by the feed unit 53 on the basis of t the result of the monitoring.

As shown in FIG. 8, the transfer processing unit 200 is provided with a displacement information acquiring unit 80 and a system control unit 300 for controlling the operation of the image forming device 1. The device control unit 300 has a transfer control unit 302 which, on the basis of paper transferring velocity Vp and skew quantity Vθ as the results of monitoring obtained by the displacement information acquiring unit 80, controls the drive mechanism unit 90 so that the paper transferring velocity Vp and skew quantity Vθ fall under preset normal ranges.

On the basis of the paper transferring velocity Vp and skew quantity Vθ as the results of monitoring obtained by the transfer state monitoring unit 81, the transfer control unit 302 which executes this transfer controlling function controls a motor (e.g., a motor 97 for the pair of transferring rolls 56 and 57) adapted to drive the drive mechanism unit 90. With this control, it becomes possible to let the paper transferring velocity Vp and skew quantity Vθ fall under respective normal ranges promptly.

Although in the construction of the image forming device 1 of this embodiment the transfer state monitoring unit 81 is installed above the printing paper within the paper feed tray 51, the place of installation of the transfer state monitoring unit 81 is not limited to above the paper feed tray 51. For example, the paper timing sensors 69 may be substituted by the transfer state monitoring unit 81. The paper timing sensors 69 used in this embodiment are for only timing information based on the paper tip position, while the transfer state monitoring unit 81 which utilizes the two-dimensional movement quantity detecting sensor 86 and the laser Doppler velocity meters 180 can detect in real time not only timing information but also the state of transfer of printing paper. Therefore, by controlling the transfer operation performed by the drive mechanism unit 90, it is possible to let the paper transferring velocity Vp and skew quantity Vθ fall under their normal ranges promptly anywhere on the transfer paths 52 and 72.

Thus, according to the transfer processing unit 200 used in this embodiment, the moving velocity of printing paper in the transfer direction and that of printing paper in the skew direction during transfer are monitored by utilizing a detection mechanism which can detect the state of motion of a moving object in a non-contact and real time manner. Therefore, the paper transferring velocity and skew quantity can be detected anywhere of the paper transfer path directly in a real time and non-contact manner and highly accurately without imposing any load on printing paper which is moving. Since the transfer system is controlled on the basis of the result of monitoring obtained by monitoring the state of transfer in the above manner, it becomes possible to effect a real-time control with a high accuracy and hence possible to make a control in such a manner that, just after occurrence of a paper transferring velocity and a skew quantity, the paper transferring velocity and the skew quantity are kept within respective predetermined ranges, that is, the operation of the transfer system is kept within its normal range.

Figure 9:
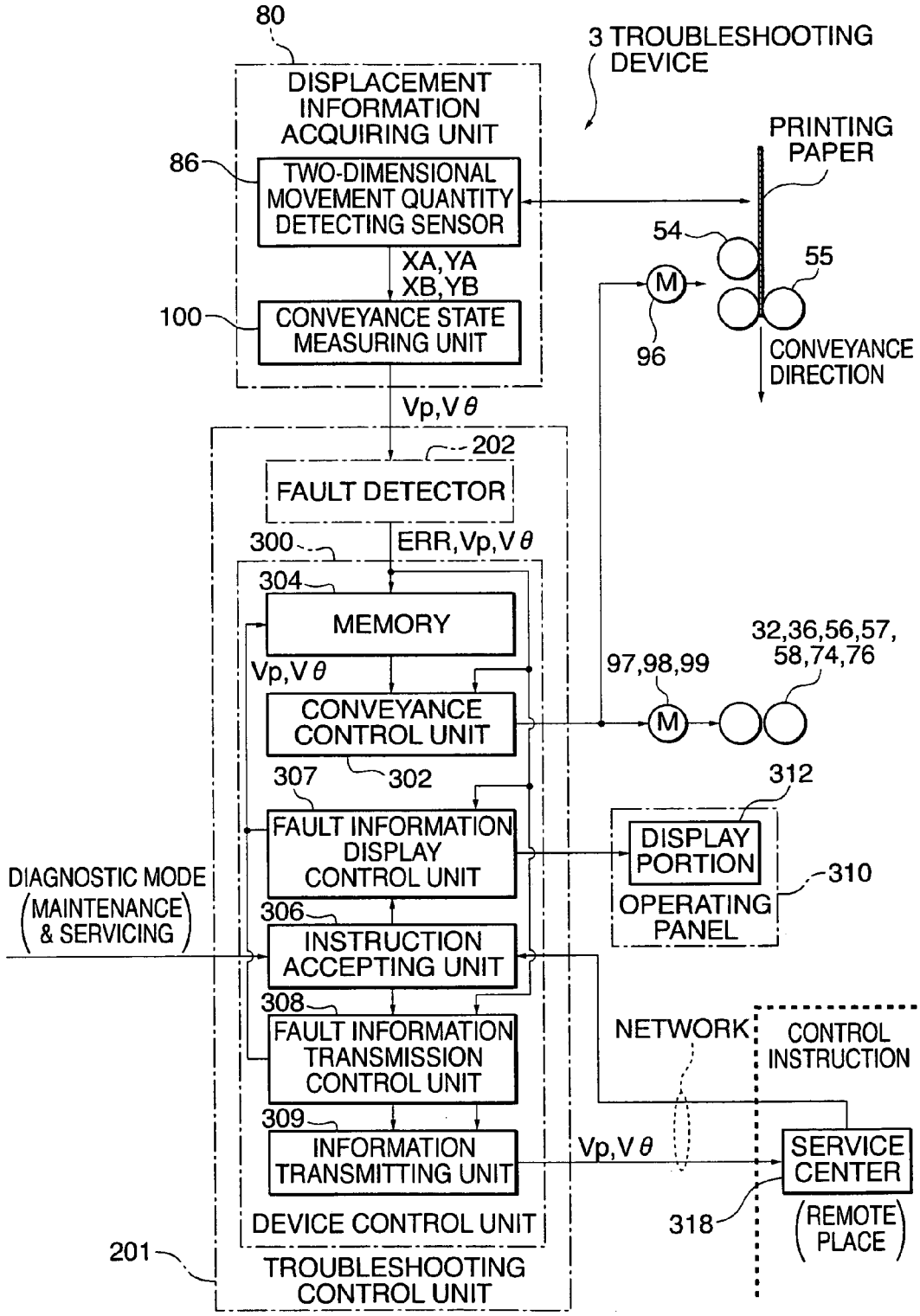
FIG. 9 is a block diagram showing a first example of construction of a troubleshooting system which diagnoses a fault on the basis of a monitoring result in the transfer state monitoring unit.

FIG. 9 is a block diagram showing the construction of a first example of a troubleshooting device 3 which diagnoses a trouble of the drive mechanism unit 90 arranged within the image forming device 1. The troubleshooting system 3 is provided in the image forming device 1 as a system which functions as one component of the transfer processing unit 200. This is also true of a second example which will be described later. As is the case with FIG. 1, the state of operation of the feed unit 53 is monitored by the transfer state monitoring unit 81 and, on the basis of the result of the monitoring, it is determined whether the feed unit 53 is at fault or not.

As shown in FIG. 9, the trouble shooting system 3 of this first example has a displacement information acquiring unit 80 and a troubleshooting control unit 201 which performs a predetermined troubleshooting operation for the drive mechanism unit 90 on the basis of moving velocities Vp and Vθ, the moving velocities Vp and Vθ being indicative of displacement information data respectively in transfer direction and skew direction obtained by the displacement information acquiring unit 80. The troubleshooting system 3 of the first example, especially the troubleshooting control unit 201, determines that a trouble occurs in the transfer system when the moving velocities Vp and Vθ in the above directions obtained by the displacement information acquiring unit 80 are outside their normal ranges, and performs an error processing according to the state of the trouble. A feature resides in this point.

The troubleshooting control unit 201 of the first example has a fault detector 202 as an example of an error determining unit which determines whether or not the paper transferring velocity Vp and skew quantity Vθ as the results of monitoring obtained by the displacement information acquiring unit 80 are within respective predetermined normal ranges, and outputs an error signal Err if the answer is negative, and also has a device control unit 300 which controls the operation of the image forming device 1.

The device control unit 300 of the first example possesses the function of an error processor which performs predetermined error processing on the basis of the error signal Err provided from the fault detector 202, the error signal Err indicating that the paper transferring velocity Vp and the skew quantity Vθ are outside their normal ranges. The device control unit 300 has a transfer control unit 302 for controlling the drive mechanism unit 90, a memory 304 which holds predetermined data, an command accepting unit 306 which accepts from the client side an command for allowing predetermined command to be displayed on a predetermined display portion (e.g., a display portion 312 of an operating panel 310), a fault information display control unit 307 which makes control so as to let predetermined information be displayed on the display portion, and a fault information transmission control unit 308 which makes control so as to transmit predetermined information through an information transmitting unit 309, the information transmitting unit 309 being network-connected to, for example, a service center located at a remote place.

The paper transferring velocity Vp and skew quantity Vθ calculated by the transfer state measuring unit 100 in the displacement information acquiring unit 80, as well as the error signal Err provided from the fault detector 202, are inputted to the device control unit 300 and can be held in the memory 304.

The transfer control unit 302, when accepting from the fault detector 202 the error signal Err indicating that the paper transferring velocity and the skew quantity have exceeded their normal ranges, controls the drive mechanism unit 90 so as to stop the printing paper transferring operation. Here, all the motors 96 to 99 are turned OFF to stop the rotation of such various roll parts as the photosensitive drum roll 32, transfer roll 35, transferring roll pairs 56, 57, 58, the pair of fixing rolls 74, and the pair of discharge rolls 76. At this time, the transfer control unit 302 utters a predetermined warning sound or message through a voice notifying part such as a buzzer or a speaker, or displays a warning message on the display portion 312 of the operating panel 310. It is preferable that an error occurrence place be indicated at the same time.

The device control unit 300 is constructed so that predetermined information data such as the paper transferring velocity Vp and skew quantity Vθ can be displayed on the display portion 312 provided on the operating panel 310 in the body of the image forming device 1, on condition that the command accepting unit 306 has accepted a diagnostic mode in maintenance and servicing. For example, the fault information display control unit 307 accepts the error signal Err from the fault detector 202 and causes the moving velocities Vp and Vθ obtained by the displacement information acquiring unit 80 to be stored in the memory 304. Thereafter, the command accepting unit 306 accepts the diagnostic mode, and in accordance with that command the fault information display unit 307 makes control so that the moving velocities Vp and Vθ are read from the memory 304 and displayed on the display portion 312.

The device control unit 300 is constructed so that it can be connected to the service center 318 through the information transmitting unit 309 and the network. As a whole there is constructed a remote diagnostic system. In this case, the device control unit 300 can transmit the paper transferring velocity Vp and skew quantity Vθ to the service center 318 side. For example, upon acceptance of the error signal Err from the fault detector 202, the fault information transmission control unit 308 makes control so that the moving velocities Vp and Vθ acquired by the displacement information acquiring unit 80 are stored in the memory 304. Thereafter, when the command accepting unit 306 accepts a control command from the service center 318, the information transmitting unit 309 makes control in accordance with the accepted command in such a manner that the moving velocities Vp and Vθ are read from the memory 304 and are transmitted to the service center 318 through the information transmitting unit 309.

In the case where the device control unit 300 is provided with both such functional units as the fault information display control unit 307 and the fault information transmission control unit 308, the device control unit 300 may be constructed such that the control function (memory control) of accepting the error signal Err from the fault detector 202 and causing the moving velocities Vp and Vθ acquired by the displacement information acquiring unit 80 to be stored in the memory 304, is used by both control units.

The entire operation of the troubleshooting system 3 of this first example will now be outlined. First, the transfer state measuring unit 100 measures the values of the paper transferring velocity Vp and skew quantity Vθ while the image forming device 1 is in normal operation and establishes normal ranges on the basis of the results of the measurement. For example, it is preferable to obtain information data 100 times or so and then establish normal ranges by utilizing mean values and standard deviations obtained from the information data In this case, it is possible to establish normal ranges suitable for various systems. Normal range may be established on the basis of a rated value of the system concerned. Thereafter, also in the state of actual operation, measurement is made by the displacement information acquiring unit 80, and the paper transferring velocity Vp and the skew quantity Vθ both calculated by the transfer state measuring unit 100 are inputted to the fault detector 202. The fault detector 202 determines whether the paper transferring velocity Vp and the skew quantity Vθ are within respective preset normal ranges or not, and if the answer is negative, the fault detector 202 produces the error signal Err.

In the transfer state monitoring unit 81, not only timing information but also the state of transfer of printing paper can be detected in real time, so that the state of paper transfer (moving velocities in the transfer direction and skew direction in this example) above the paper feed tray 51 can be detected accurately in real time. Therefore, if there is any trouble in the state of printing paper transfer on the paper feed tray 51, the fault detector 202 can detect the trouble immediately.

If the error signal Err is present, the fault information display control unit 307 and the fault information transmission control unit 308 in the device control unit 300 causes both paper transferring velocity Vp and skew quantity Vθ to be stored as input data in the memory 304. Further, with the error signal Err ON, the transfer control unit 302 in the device control unit 300 brings the whole of the image forming device 1 to a stop. As a result, it is possible to prevent the occurrence of paper jam in an early stage.

The fault information display control unit 307 accepts the diagnostic mode in maintenance and servicing through the command accepting unit 306 and causes the moving velocities Vp and Vθ which have been held as input data in the memory 304 to be displayed on the operating panel 310 in the body of the image forming device 1. By so doing, the efficiency of specifying the cause of jam occurrence is improved.

When the command accepting unit 306 accepts a control command from the service center 318, the device control unit 300, in accordance with the control command transmits both paper transferring velocity Vp and skew quantity Vθ to the service center 318 through the information transmitting unit 309, whereby it becomes possible to troubleshoot the image forming device 1 from a remote place.

As described earlier in connection with the transfer control function based on the result of monitoring in the transfer state monitoring unit, the paper timing sensors 69 may be substituted by the transfer state monitoring unit 81. In this state, the state of printing paper transfer can be detected in real time by the transfer state monitoring unit 81 which is arranged in various positions above the transfer path, so it is possible to detect accurately in real time whether the drive mechanism unit 90 which functions as the paper transfer device is at fault or not.

Thus, according to the troubleshooting system 3 of this first example, the moving velocity in the transfer direction and the moving velocity in the skew direction of printing paper being transferred are monitored by utilizing the detection mechanism which can detect the state of motion of a moving object in a non-contact and real time manner, so that, anywhere of the paper transfer path, both paper transferring velocity and skew quantity can be detected directly in a non-contact real time manner without imposing any load on printing paper. On the basis of the result of having monitored the state of transfer in such a way, there is made diagnosis as to whether there is any trouble in the transfer system or not, so that a malfunction of the transfer system, upon occurrence thereof, can be determined with a high accuracy without applying any load to the printing paper which is moving. By detecting the paper transferring velocity and skew quantity in real time, it is possible to turn OFF the recording system before occurrence of paper jam which is difficult to be remedied and hence possible to prevent the occurrence of the paper jam.

Figure 10:
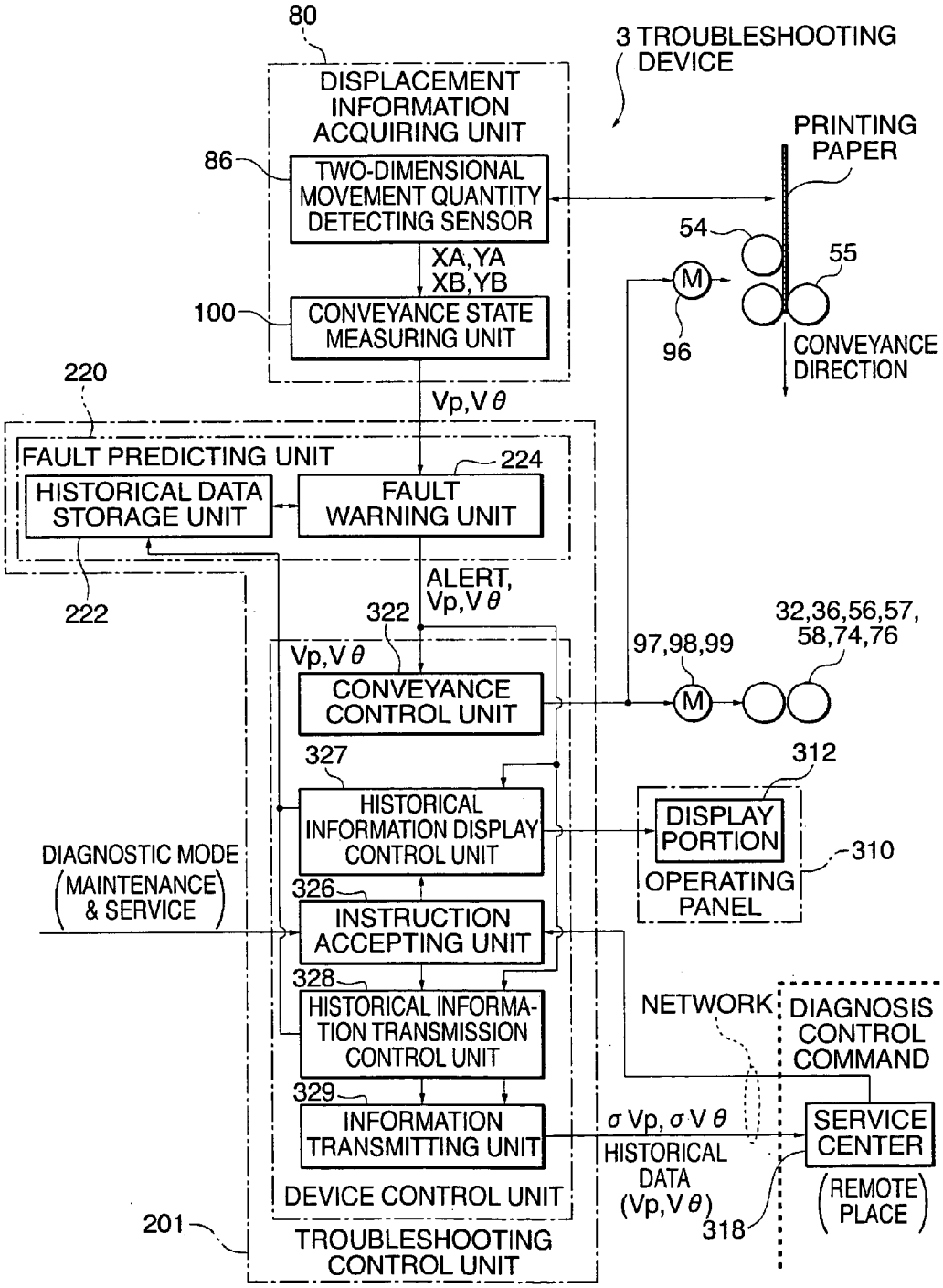
FIG. 10 illustrates a second example of a troubleshooting system which diagnoses a fault on the basis of a monitoring result in the transfer state monitoring unit.

FIG. 10 illustrates a second example of the troubleshooting system 3 which diagnoses a fault of the drive mechanism unit 90 in the image forming device 1 on the basis of the result of monitoring performed in the transfer state monitoring unit 81. The troubleshooting system 3 of this second example which functions as a warning signal output system, as is the case with the construction of the first example, has a displacement information acquiring unit 80 and a troubleshooting control unit 201 which performs a predetermined troubleshooting operation for the drive mechanism unit 90 on the basis of moving velocities Vp and Vθ indicating displacement information data respectively in the transfer direction and skew direction and obtained by the displacement information acquiring unit 80.

The troubleshooting system 3 of this second example, especially the troubleshooting control unit 201, acquires periodically moving velocities Vp and Vθ in the above directions through the displacement information acquiring unit 80, stores them in memory as history data, reads out predetermined history data at a predetermined timing, performs data processing for the read data to determine index values for decision, determines, when the index values are outside reference values, that the transfer system is deteriorated and that there is a fear of occurrence of a trouble in the near future, and performs maintenance processing according to the deterioration decision. A feature resides in this point. According to the gist of this description, even in a normal mode involving actual occurrence of a fault, a deterioration state of the transfer system is diagnosed and an appropriate processing matching the degree of deterioration is performed to constitute an efficient maintenance system.

The troubleshooting control unit 201 of this second example is provided with a fault predicting unit 220 which constantly monitors both paper transferring velocity Vp and skew quantity Vθ (hereinafter referred to also as monitoring data Vp and Vθ) as the results of monitoring obtained by the displacement information acquiring unit 80, obtains predetermined decision index values on the basis of monitoring data Vp and Vθ at each monitoring time point, determines whether the decision index values are within predetermined reference values or not, and if the decision index values exceed reference values, outputs a warning signal, and is also provided with a device control unit 320 which controls the operation of the image forming device 1.

The fault predicting unit 220 has a historical data storage unit 222 which holds both paper transferring velocity Vp and skew quantity Vθ (i.e., monitoring data Vp and Vθ) as the results of monitoring obtained in the transfer state monitoring unit 81, and a fault warning unit 224 as an example of a deterioration determining unit which reads out at a predetermined timing the monitoring data Vp and Vθ stored in the historical data storage unit 222, performs predetermined arithmetic processing for the thus-read data to determine decision index values, and determines whether the warning signal Alert is to be outputted out not.

For example, the predetermined timing may be a predetermined time once a day. With respect to the feed rolls (pickup roll 54 and a pair of paper feed rolls 55) in the feed unit 53 and such transferring rolls as the transferring roll pairs 56 to 58, the distribution of paper transferring velocities is characterized by being narrow in an initial state but becoming wider in a deteriorated state.

Therefore, the fault warning unit 224 uses standard deviations as decision index values (feature quantities) at the time of outputting the warning signal Alert. More specifically, standard deviations in an initial state are σVp0, σVθ0 but if the magnitudes of historical data standard deviations σVp, σVθ exceed reference values, the fault warning unit 224 outputs the warning signal Alert. The storage of historical data for calculating standard deviations is conducted for example in such a manner that the latest 100-time monitoring data Vp and Vθ are held and are overwritten successively.

The device control unit 320 of this second example has the function of a maintenance processing unit which performs predetermined maintenance processing on the basis of the warning signal Alert indicating that the aforesaid standard deviations have exceeded the reference values from the fault predicting unit 220. It is substantially of the same construction as the device control unit 300 of the first embodiment. For example, the device control unit 320 of this second example has a transfer control unit 322 which controls the drive mechanism unit 90, an command accepting unit 326 which accepts from the client side an command for displaying predetermined information on a predetermined display portion (e.g., a display portion 312 of an operating panel 310), a historical information display control unit 327 which makes control so as to display historical data and other information on a predetermined display portion, and a historical information transmission control unit 328 which makes control so as to transmit historical data and other information through an information transmitting unit 329 network-connected to the service center 318. This is almost equal to the construction wherein the memory 304 is shifted as the historical data storage unit 222 to the fault predicting unit 220 side and a 300-mark referencer of a functional element in the device control unit 300 is replaced by a 320-mark referencer. Both are similar to each other in the greater parts of their functions although the information to be displayed on the display portion 312 or to be transmitted to the exterior is different between the two. A description will be given below about only such points as are different from the device control unit 300 of the first example.

For example, the device control unit 320 is constructed in such a manner that maintenance time information such as, for example, "It is the maintenance time of the paper feed unit . . . ," or specific information such as a maintenance service communication place, can be displayed on the display portion 312 which is provided on the operating panel 310 in the body of the image forming device 1. Further, in the device control unit 320, the command accepting unit 320 accepts a diagnostic mode for maintenance service, and in accordance with this control command the historical information display control unit 327 makes control so as to display the standard deviation data σVp and σVθ, or historical data, of both paper transferring velocity Vp and skew quantity Vθ on the display panel.

The device control unit 320 is constructed so that it can be connected to the service center 318 through the information transmitting unit 329 and network. A remote diagnostic system is constituted as a whole. In this case, the historical information transmission control unit 328 in the device control unit 320 makes control so as to notify the service center 318 of maintenance request information or a manager's communication place for a copying machine, etc. through the information transmitting unit 329. In this case, the command accepting unit 326 accepts a diagnosis control command from the service center 318, and in accordance with that command, the historical information transmission control unit 328 makes control in such a manner that the standard deviation data σVp and σVθ, or historical data, of both paper transferring velocity Vp and skew quantity Vθ are transmitted to the service center 318 through the information transmitting unit 329.

An entire operation of the troubleshooting system 3 of this second example will now be outlined. First, when the image forming device 1 is in a normal state, the troubleshooting system 3 causes a normal operation (e.g., copying operation) of the image forming device 1 to be done q times and acquires both paper transferring velocity Vp and skew quantity Vθ through the displacement information acquiring unit 80. As to the number of repetition, q, about 100 times will do as is the case with determining standard deviations of monitoring data Vp and Vθ. It is preferable that this measurement is made when an object to be inspected is new, for example, in an initial state (in a normal state inevitably) such as a shipping stage of the image forming device 1 or at the time of parts replacement.

The fault warning unit 224 in the fault predicting unit 220 calculates standard deviations σVp, σVθ of the acquired paper transferring velocity Vp and skew quantity Vθ and store them as reference values (standard deviations σVp0, σVθ0) into a predetermined storage medium (e.g., non-volatile memory; the historical data storage unit 222 will do). In the case where displacement information acquiring units 80 substitute for the paper timing sensors 69 above the transfer paths 52 and 72, in addition to the displacement information acquiring unit 80 arranged above the paper feed tray 51, the above standard deviations as reference values are stored so as to clarify how they are correlated with the installed positions of the displacement information acquiring units.

Also in a state of actual operation the troubleshooting system 3 causes the displacement information acquiring unit 80 to measure both paper transferring velocity Vp and skew quantity Vθ. Outputs Vp and Vθ from the transfer state measuring unit 100 are inputted to the fault warning unit 224, which in turn once stores the inputted monitoring data Vp and Vθ successively into the historical data storage unit 222. At this time, the historical data storage unit 222 holds the latest 100-time monitoring data Vp and Vθ, which are overwritten successively.

Then, the troubleshooting system 3 compares the distribution of the acquired paper transferring velocities Vp and skew quantities Vθ in actual operation with distribution in a truly normal state acquired in advance, thereby predicting the occurrence of a fault of roll parts arranged in the paper transfer system. For example, the fault warning unit 224 reads out at a predetermined timing the 100-time monitoring data Vp and Vθ stored in the historical data storage unit 222 and calculates standard deviations σVp, σVθ of the historical data group.

Next, the fault warning unit 224 compares the standard deviations σVp and σVθ as feature quantities in actual operation with corresponding reference values (standard deviations σVp0, σVθ0) which have been read out from the historical data storage unit 222, and determines the state of deterioration of roll parts arranged in the paper transfer system. This is equivalent to predicting a fault of roll parts.

In this comparison for predictive diagnosis, for example if the feature quantities (standard deviations σVp, σVθ) in actual operation are 3 to 4 times or more of the initial-state standard deviations σVp0 and σVθ0, it is determined that a fault will occur in the near future. In the case where the actual-operation feature quantities (standard deviations σVp, σVθ) are within the reference values, the fault warning unit 224 determines that the roll parts are in a normal state, while when the actual-operation feature quantities (standard deviations σVp, σVθ) are in excess of the standard values, the fault warning unit 224 determines that the roll parts are in a deteriorated state (that is, a fault of the roll parts will occur in the near future), then issues the warning signal Alert and provides it to the device control unit 320. Further, in response to a request signal provided from the device control unit 320, the fault warning unit 224 outputs standard deviation data σVp and σVθ, or historical data, of both paper transferring velocity Vp and skew quantity Vθ.

In the case where displacement information acquiring units 80 substitute for the paper timing sensors 69 above the transfer paths 52 and 72, in addition to the displacement information acquiring unit 80 arranged above the paper feed tray 51, the fault warning unit 224 repeats the same processing as above also for the other displacement information acquiring units 80 and thereby determines the possibility of fault occurrence of the drive mechanism unit 90 also in connection with the other displacement information acquiring units 80.

When the warning signal Alert is ON, the historical information display control unit 327 in the device control unit 320 makes control so that maintenance time information such as, for example, "It is the maintenance time of the paper feed unit . . . ," or a maintenance service communication place is displayed on the display portion 312 which is provided on the operating panel 310 in the body of the image forming device 1. Further, in the diagnostic mode for maintenance service, the historical information display control unit 327 makes control in accordance with a control command so as to display the standard deviation data σVp and σVθ, or historical data, of both paper transferring velocity Vp and skew quantity Vθ on the display panel.

The historical information transmission control unit 328 in the device control unit 300 makes control so as to notify the service center 318 of maintenance request information or a manager's communication place for a copying machine, etc. through the network. Further, in accordance with a diagnosis control command issued from the service center 318 and accepted by the command accepting unit 326, the historical information transmission control unit 328 makes control so that the standard deviation data σVp and σVθ, or historical data, of both paper transferring velocity Vp and skew quantity Vθ are transmitted to the service center 318.

Thus, according to the troubleshooting system 3 of this second example, the moving velocity in the transfer direction and the moving velocity in the skew direction of printing paper being transferred are monitored by utilizing a detection mechanism which can detect the state of motion of a moving object in a non-contact manner and in real time, so that anywhere of the paper transfer path both paper transferring velocity and skew quantity can be detected in a non-contact real time manner and highly accurately without imposing any load on the printing paper which is moving.

Since the state of deterioration of the transfer system is diagnosed directly and constantly on the basis of the result of having monitored the state of transfer in the above manner, the state of deterioration of the transfer system can be determined with a high accuracy without applying any load to the printing paper which is moving. Consumable components such as transferring rolls have heretofore been incapable of being measured directly for the state of deterioration and therefore replaced earlier on the basis of counter information which indicates the state of use, but by measuring the state of deterioration (especially moving velocities in both transfer direction and skew direction) of printing paper directly and in a non-contact manner it is possible to monitor the state of deterioration constantly and hence possible to improve the efficiency of maintenance service.

Although the present invention has been described above by way of embodiments thereof, the technical scope of the present invention is not limited to the scope described in the above embodiments. Various changes or modifications may be added to the above embodiments insofar as they do not depart from the gist of the present invention. Embodiments including such changes or modifications are also included in the technical scope of the present invention.

The above embodiments do not restrict the claimed invention, nor all of the combinations of features described in the above embodiments are essential to the present invention. Various stages of inventions are included in the above embodiments and various inventions can be extracted by suitable combinations of plural constructional conditions disclosed in the above embodiments. Even if several constructional conditions are deleted from all of the constructional conditions shown in the above embodiments, the construction after deletion of such several constructional conditions can be extracted as invention insofar as there is obtained an effect.

For example, although in the above embodiments the transfer device is applied to the image forming device 1 provided with the image forming unit 30 which forms an image on printing paper as an example of an object to be transferred after being moved to a predetermined position, the object to be transferred is not always limited to printing paper, and it may be, for example, film or a plate-like object (e.g., metallic sheet). Thus, the object to be transferred in the transfer device is not specially limited.

According to the present invention, as set forth above, a predetermined measuring wave is applied to an object to be transferred and a measured wave from the object to be transferred which wave corresponds to the measuring wave is detected; for example, there is adopted a method wherein a moving velocity of a moving object is measured by utilizing the Doppler effect or a method wherein a structural feature appearing on the surface of an object is observed by a photo-detector array to detect the position and motion of the object, thereby acquiring displacement information data in both transfer direction and skew direction of the object which is moving.

In this way, displacements in both transfer direction and skew direction of a moving object can be monitored anywhere in the transfer system directly and in a non-contact real time manner. As a result, also at the time of controlling the operation of the transfer system highly accurately and in real time on the basis of the acquired displacement information or at the time of determining a fault or a deteriorated state, it is possible to effect each determining process highly accurately and in real time.

Moreover, since each determining process can be done highly accurately and in real time, for example by detecting both paper transferring velocity and skew quantity in real time it is possible to stop the device before the occurrence of paper jam which is difficult to eliminate and thereby prevent the occurrence of such paper jam or it is possible to make control so as to suppress both paper transferring speed and skew quantity within the ranges of predetermined velocity and skew quantity just after an occurrence of such paper transferring velocity and skew quantity as are outside their normal ranges. Further, by monitoring deterioration of paper transferring rolls constantly, it becomes possible to improve the efficiency of maintenance service.

The entire disclosure of Japanese Patent Application No. 2003-201466 filed on Jul. 25, 2003 including specification, claims, drawings and abstract is incorporated herein by reference in its entirety.

What is claimed is:

1. A transfer device for transferring an object to be transferred in a predetermined direction, comprising:

a drive mechanism unit that includes roll parts which cause the object to be transferred to move in the predetermined direction with a rotational force;

a transfer direction displacement information acquiring unit that radiates a predetermined measuring wave toward the object to be transferred, detects a wave from the object to be transferred as a measured wave that corresponds to the measuring wave, and acquires displacement information in a transfer direction of the object to be transferred that is moved by the drive mechanism unit;

a skew direction displacement information acquiring unit that radiates a predetermined measuring wave toward the object to be transferred, detects a wave from the object to be transferred as a measured wave that corresponds to the measuring wave, and acquires displacement information in a skew direction substantially orthogonal to the transfer direction of the object to be transferred that is moved by the drive mechanism unit; and a transfer processing unit that, on the basis of the displacement information in each of the transfer direction and the skew direction acquired by the transfer direction displacement information acquiring unit and the skew direction displacement information acquiring unit, performs predetermined processing according to a state of transfer of the object to be transferred.

2. The transfer device according to claim 1, wherein at least one of the transfer direction displacement information acquiring unit and the skew direction displacement information acquiring unit comprises:

an irradiation unit that radiates the measuring wave toward the object to be transferred;

a movement quantity detecting sensor that includes a detector array of a plurality of detectors for detecting the measured wave, the movement quantity detecting sensor being adapted to detect a structural feature of a surface of the object to be transferred through the detector array and thereby measure a movement quantity of the object to be transferred in a predetermined reference axis direction; and a transfer state measuring unit that, on the basis of the movement quantity of the to-be-transferred object detected by the movement quantity detecting sensor, calculates a moving velocity as the displacement information and as a movement quantity per unit time of the object to be transferred in the reference axis direction.

3. The transfer device according to claim 2, wherein the sensor detects the measured wave in a plurality of mutually perpendicularly intersecting directions as the predetermined reference axis directions.

4. The transfer device according to claim 1, wherein at least one of the transfer direction displacement information acquiring unit and the skew direction displacement information acquiring unit comprises:

an irradiation unit that radiates the measuring wave toward the object to be transferred; and a measured wave detecting sensor which detects the measured wave having a Doppler shift according to the moving velocity of the object to be transferred, wherein a frequency displacement of the measured wave is detected on the basis of information of the measured wave detected by the measured wave detecting sensor and a moving velocity of the object to be transferred in a predetermined reference axis direction is measured.

5. The transfer device according to claim 1, wherein at least one of the transfer direction displacement information acquiring unit and the skew direction displacement information acquiring unit comprises:

a conversion calculation unit that converts the acquired displacement information of the object to be transferred into a value in the transfer direction or in the skew direction on the basis of a tolerance between a reference axis direction in which the at least one displacement information acquiring unit can detect displacement information in the transfer direction or the skew direction of the object to be transferred.

6. The transfer device according to claim 1, further comprising:

a tray for setting the object to be transferred;

a transfer path along which the object to be transferred is transferred with operation of the drive mechanism unit; and a feed unit operated by the drive mechanism unit that draws out the object to be transferred from the tray toward the transfer path, wherein the transfer direction displacement information acquiring unit monitors a moving motion in the transfer direction of the object to be transferred that is drawn out from the tray toward the transfer path by the feed unit, and the skew direction displacement information acquiring unit monitors a moving motion in the skew direction of the object to be transferred that is drawn out from the tray toward the transfer path by the feed unit.

7. The transfer device according to claim 1, further comprising:

a transfer path along which the object to be transferred is transferred by operation of the drive mechanism unit, wherein the transfer direction displacement information acquiring unit monitors, at a predetermined position of the transfer path, a moving motion in the transfer direction of the object to be transferred, and the skew direction displacement information acquiring unit monitors, at a predetermined position of the transfer path, a moving motion in the skew direction of the object to be transferred.

8. The transfer device according to claim 1, wherein the transfer processing unit comprises:

a transfer control unit that, on the basis of the displacement information data in the transfer direction and the skew direction acquired by the transfer direction displacement information acquiring unit and the skew direction displacement information acquiring unit, controls the drive mechanism unit in such a manner that the moving velocity and skew quantity in the transfer direction of the object to be transferred fall under respective normal ranges.

9. The transfer device according to claim 1, wherein the transfer processing unit has a troubleshooting control unit that performs predetermined troubleshooting operation for the drive mechanism unit on the basis of the displacement information data in the transfer direction and the skew direction acquired by the transfer direction displacement information acquiring unit and the skew direction displacement information acquiring unit.

10. The transfer device according to claim 9, wherein the troubleshooting control unit comprises:

a data storage unit that constantly stores the displacement information data in the transfer direction and the skew direction acquired by the transfer direction displacement information acquiring unit and the skew direction displacement information acquiring unit, or predetermined information corresponding to the displacement information;

a deterioration determining unit that reads out only a predetermined quantity of the information from the data storage unit at a predetermined timing, performs predetermined arithmetic processing on the basis of historical data corresponding to the predetermined quantity of the information to determine a feature quantity suitable for fault prediction, determines whether the determined feature quantity lies within a preset reference value or not, and on condition that the feature quantity exceeds the reference value, outputs information indicating the condition; and a maintenance processing unit that performs predetermined maintenance processing on the basis of information provided from the deterioration determining unit, which information indicates that the feature quantity has exceeded the reference value.

11. The transfer device according to claim 10, wherein the maintenance processing unit comprises:

a command accepting unit that accepts a command for displaying predetermined information on a predetermined display portion; and a historical information display control unit that accepts from the deterioration determining unit information indicating that the feature quantity has exceeded the reference value and which, on condition that the command accepting unit has accepted the command, makes control so as to read out the historical data stored in the data storage unit and display the read data on the predetermined display portion.

12. The transfer device according to claim 10, wherein the maintenance processing unit comprises:

an information transmitting unit that transmits predetermined information to the exterior;

a command accepting unit that accepts a command for notifying predetermined information through the information transmitting unit; and a historical information transmission control unit that accepts from the deterioration determining unit information indicating that the feature quantity has exceeded the reference value and which, on condition that the command accepting unit has accepted the command, makes control so as to read out the historical data stored in the data storage unit and transmit the read data to the exterior through the information transmitting unit.

13. The transfer device according to claim 9, wherein the troubleshooting control unit comprises:

an error determining unit that determines whether or not the displacement information data in the transfer direction and the skew direction acquired by the transfer direction displacement information acquiring unit and the skew direction displacement information acquiring unit lie within respective preset normal ranges, and which, on condition that the displacement information data are in excess of the normal ranges, outputs information indicating the condition; and an error processing unit that performs predetermined error processing on the basis of the information provided from the error determining unit and indicating that the displacement information data are in excess of the normal ranges.

14. The transfer device according to claim 13, wherein the error processing unit comprises:

a transfer control unit that, upon receiving from the error determining unit information indicating the displacement information data is in excess of the normal ranges, controls the drive mechanism unit so as to stop transferring operation for the object to be transferred.

15. The transfer device according to claim 13, wherein the error processing unit comprises:

a data storage unit that stores predetermined data;

a command accepting unit that accepts a command for displaying predetermined information on a predetermined display portion; and a fault information display control unit that, upon receiving from the error determining unit information indicating the displacement information data is in excess of the normal ranges, stores the displacement information data in the transfer direction and the skew direction acquired by the transfer direction displacement information acquiring unit and the skew direction displacement information acquiring unit, or predetermined information corresponding to the displacement information, as the predetermined data into the data storage unit, and which thereafter, when the command accepting unit has accepted the command, controls operation so as to read out the information from the data storage unit and display it on the predetermined display portion.

16. The transfer device according to claim 13, wherein the error processing unit comprises:

a data storage unit that stores predetermined data;

an information transmitting unit that transmits predetermined information to the exterior;

a command accepting unit that accepts a command for notifying predetermined information through the information transmitting unit; and a fault information transmission control unit that, upon receiving from the error determining unit information indicating the displacement information data is in excess of the normal ranges, stores the displacement information data in the transfer direction and the skew direction acquired by the transfer direction displacement information acquiring unit and the skew direction displacement information acquiring unit, or predetermined information corresponding to the displacement information, as the predetermined data into the data storage unit, and which thereafter, on condition that the command accepting unit has accepted the command, makes control so as to read out the information from the data storage unit and transmit it to the exterior through the information transmitting unit.

17. An image forming device comprising the transfer device according to claim 1 and an image forming unit that forms an image on the object to be transferred that has been moved in the predetermined direction by the transfer device.

18. A transfer method for transferring an object to be transferred in a predetermined direction comprising:

radiating a predetermined measuring wave toward the object to be transferred;

detecting a wave from the object to be transferred as a measured wave that corresponds to the measuring wave;

acquiring displacement information in a transfer direction of the object to be transferred and displacement information in a skew direction substantially orthogonal to the transfer direction of the object to be transferred; and performing predetermined processing according to a state of transfer of the object to be transferred, on the basis of the displacement information in each of the acquired transfer direction and the acquired skew direction.

* * * * *